US006054972A

United States Patent [19]

Otani et al.

[11] Patent Number: 6,054,972

[45] Date of Patent: Apr. 25, 2000

[54] METHOD AND APPARATUS FOR DRIVING A PASSIVE MATRIX LIQUID CRYSTAL DISPLAY DEVICE

[75] Inventors: Toshiya Otani, Sennan; Masahito Matsunami, Hirakata; Kazuhiro Nakanishi, Moriguchi, all of Japan

[73] Assignee: Matsushita Electric Industrial Co., Ltd., Osaka, Japan

[21] Appl. No.: 08/936,023

[22] Filed: Sep. 23, 1997

Related U.S. Application Data

[63] Continuation of application No. 08/418,581, Apr. 6, 1995, abandoned.

[30] Foreign Application Priority Data

Apr. 19, 1994 [JP] Japan ..... 6-080548
Jul. 5, 1994 [JP] Japan ..... 6-153925

[51] Int. Cl.[7] ..... G09G 3/36

[52] U.S. Cl. ..... 345/89; 345/147

[58] Field of Search ..... 345/89, 147, 100

[56] References Cited

U.S. PATENT DOCUMENTS 5,252,959 10/1993 Kono ..... 345/147
5,254,982 10/1993 Feigenblatt et al. ..... 345/148
5,264,839 11/1993 Kanno et al. ..... 345/98
5,307,084 4/1994 Yamaguchi et al. ..... 345/58
5,400,044 3/1995 Thomas ..... 345/89
5,412,395 5/1995 Maeda et al. ..... 345/89
5,459,495 10/1995 Scheffer et al. ..... 345/89

FOREIGN PATENT DOCUMENTS 62-030473 2/1987 Japan .
4-102892 4/1992 Japan .
5-158442 6/1993 Japan .
6-51276 2/1994 Japan .

*Primary Examiner*—Amare Mengistu
*Attorney, Agent, or Firm*—Morrison & Foerster LLP

[57] ABSTRACT

A passive matrix liquid crystal display device which can display high-quality gradation by reducing cross-talk and improving contrast is attained. A driving apparatus comprises a field memory of picture image data for storing picture images being input from outside; a readout circuit of picture image data for reading out each element in a specific column of a matrix of picture image data; a calculation circuit of gradation correction term for calculating a gradation correction term from the readout picture image data; a memory of scan data for storing scan data in advance; a readout circuit of scan data for reading out specific scan data from the memory of scan data; an operation circuit of each element for operating a matrix of signal data based on picture image data of a specific column being read out from the field memory of picture image data and scan data being read out from the memory of scan data; and a field memory of signal data for storing data after being operated.

11 Claims, 22 Drawing Sheets

$$
\begin{array}{ccc}
10 & 21 & 31 \\
\begin{bmatrix}
1 & 1 & 1 & 1 & \cdots & 0 & 0 & 0 & 0 & 0 & 0 & 0 & 0 \\
1 & 1 & 1 & 1 & \cdots & 0 & 0 & 0 & 0 & 0 & 0 & 0 & 0 \\
1 & 1 & -1 & -1 & \cdots & 0 & 0 & 0 & 0 & 0 & 0 & 0 & 0 \\
1 & 1 & -1 & -1 & \cdots & 0 & 0 & 0 & 0 & 0 & 0 & 0 & 0 \\
 & \vdots & & & & & & & & \vdots & & & \\
 & \vdots & & & & & & & & \vdots & & & \\
 & \vdots & & & & & & & & \vdots & & & \\
 & \vdots & & & & & & & & \vdots & & & \\
0 & 0 & 0 & 0 & \cdots & 1 & 1 & 1 & 1 & 1 & 1 & 1 & 1 \\
0 & 0 & 0 & 0 & \cdots & 1 & 1 & 1 & 1 & -1 & -1 & -1 & -1 \\
0 & 0 & 0 & 0 & \cdots & 1 & 1 & -1 & -1 & -1 & -1 & 1 & 1 \\
0 & 0 & 0 & 0 & \cdots & 1 & 1 & -1 & -1 & 1 & 1 & -1 & -1 \\
0 & 0 & 0 & 0 & \cdots & 1 & -1 & -1 & 1 & 1 & -1 & -1 & 1 \\
0 & 0 & 0 & 0 & \cdots & 1 & -1 & -1 & 1 & -1 & 1 & 1 & -1 \\
0 & 0 & 0 & 0 & \cdots & 1 & -1 & 1 & -1 & -1 & 1 & -1 & 1 \\
0 & 0 & 0 & 0 & \cdots & 1 & -1 & 1 & -1 & 1 & -1 & 1 & -1
\end{bmatrix}
&
\begin{bmatrix}
1 & 0 \\
1 & 0 \\
1 & 0 \\
1 & 0 \\
\vdots & \vdots \\
\vdots & \vdots \\
\vdots & \vdots \\
\vdots & \vdots \\
1 & 1 \\
1 & 1 \\
1 & 1 \\
1 & 1 \\
1 & 1 \\
1 & 1 \\
1 & 1 \\
0 & \sqrt{240}
\end{bmatrix}
=
\begin{bmatrix}
(1) & 8 & (249) & 8 \\
(2) & 0 & (249) & 0 \\
(3) & 0 & (249) & 0 \\
(4) & 0 & (249) & 0 \\
 & & & \vdots \\
 & & & \vdots \\
 & & & \vdots \\
 & & & \vdots \\
(241) & 7 & (489) & 7 + \sqrt{240} \\
(242) & 1 & (490) & 1 - \sqrt{240} \\
(243) & -1 & (491) & -1 + \sqrt{240} \\
(244) & 1 & (492) & 1 - \sqrt{240} \\
(245) & -1 & (493) & -1 + \sqrt{240} \\
(246) & 1 & (494) & 1 - \sqrt{240} \\
(247) & -1 & (495) & -1 + \sqrt{240} \\
(248) & 1 & (496) & 1 - \sqrt{240}
\end{bmatrix}
\\
 & 40 \quad 40 & 60 \quad 60 & 51
\end{array}
$$

FIG. 3

$$
\begin{array}{ccccc}
12 & 23 & & 52 & 33 \\
\begin{bmatrix}
1 & 1 & 1 & 1 & 1 & 1 & 1 & 1 \\
1 & 1 & 1 & 1 & -1 & -1 & -1 & -1 \\
1 & 1 & -1 & -1 & -1 & -1 & 1 & 1 \\
1 & 1 & -1 & -1 & 1 & 1 & -1 & -1 \\
1 & -1 & -1 & 1 & 1 & -1 & -1 & 1 \\
1 & -1 & -1 & 1 & -1 & 1 & 1 & -1 \\
1 & -1 & 1 & -1 & -1 & 1 & -1 & 1 \\
1 & -1 & 1 & -1 & 1 & -1 & 1 & -1
\end{bmatrix}
&
\begin{bmatrix}
1 & 0 \\
1 & 0 \\
1 & 0 \\
1 & 0 \\
1 & 0 \\
1 & 0 \\
1 & 0 \\
0 & \sqrt{7}
\end{bmatrix}
&=
&
\begin{bmatrix}
(1) & 7 & (9) & \sqrt{7} \\
(2) & 1 & (10) & -\sqrt{7} \\
(3) & -1 & (11) & \sqrt{7} \\
(4) & 1 & (12) & -\sqrt{7} \\
(5) & -1 & (13) & \sqrt{7} \\
(6) & 1 & (14) & -\sqrt{7} \\
(7) & -1 & (15) & \sqrt{7} \\
(8) & 1 & (16) & -\sqrt{7}
\end{bmatrix}
\\
 & 42 & & 60 & 60
\end{array}
$$

FIG. 6

$$
\begin{array}{ccccc}
12 & 23 & & 52 & 33 \\
\begin{bmatrix}
1 & 1 & 1 & 1 & 1 & 1 & 1 & 1 \\
1 & 1 & 1 & 1 & -1 & -1 & -1 & -1 \\
1 & 1 & -1 & -1 & -1 & -1 & 1 & 1 \\
1 & 1 & -1 & -1 & 1 & 1 & -1 & -1 \\
1 & -1 & -1 & 1 & 1 & -1 & -1 & 1 \\
1 & -1 & -1 & 1 & -1 & 1 & 1 & -1 \\
1 & -1 & 1 & -1 & -1 & 1 & -1 & 1 \\
1 & -1 & 1 & -1 & 1 & -1 & 1 & -1
\end{bmatrix}
&
\begin{bmatrix}
1 & 0 \\
1 & 0 \\
1 & 0 \\
1 & 0 \\
1 & 0 \\
1 & 0 \\
1 & 0 \\
0 & \sqrt{7}
\end{bmatrix}
&=
&
\begin{bmatrix}
(1) & 7 & (2) & \sqrt{7} \\
(3) & 1 & (4) & -\sqrt{7} \\
(5) & -1 & (6) & \sqrt{7} \\
(7) & 1 & (8) & -\sqrt{7} \\
(9) & -1 & (10) & \sqrt{7} \\
(11) & 1 & (12) & -\sqrt{7} \\
(13) & -1 & (14) & \sqrt{7} \\
(15) & 1 & (16) & -\sqrt{7}
\end{bmatrix}
\\
 & 42 & & 61 & 61
\end{array}
$$

FIG. 8

310 311 312

$$\begin{bmatrix} 1 & 0 & 0 & 0 \\ 0 & 1 & 0 & 0 \\ 0 & 0 & 1 & 0 \\ 0 & 0 & 0 & 1 \end{bmatrix} \times \begin{bmatrix} 1 & 1 & 1 & 1 \\ 1 & -1 & 1 & -1 \\ 1 & 1 & -1 & -1 \\ 1 & -1 & -1 & 1 \end{bmatrix} = \begin{bmatrix}
1 & 1 & 1 & 1 & 0 & 0 & 0 & 0 & 0 & 0 & 0 & 0 & 0 & 0 & 0 & 0 \\
1 & -1 & 1 & -1 & 0 & 0 & 0 & 0 & 0 & 0 & 0 & 0 & 0 & 0 & 0 & 0 \\
1 & 1 & -1 & -1 & 0 & 0 & 0 & 0 & 0 & 0 & 0 & 0 & 0 & 0 & 0 & 0 \\
1 & -1 & -1 & 1 & 0 & 0 & 0 & 0 & 0 & 0 & 0 & 0 & 0 & 0 & 0 & 0 \\
0 & 0 & 0 & 0 & 1 & 1 & 1 & 1 & 0 & 0 & 0 & 0 & 0 & 0 & 0 & 0 \\
0 & 0 & 0 & 0 & 1 & -1 & 1 & -1 & 0 & 0 & 0 & 0 & 0 & 0 & 0 & 0 \\
0 & 0 & 0 & 0 & 1 & 1 & -1 & -1 & 0 & 0 & 0 & 0 & 0 & 0 & 0 & 0 \\
0 & 0 & 0 & 0 & 1 & -1 & -1 & 1 & 0 & 0 & 0 & 0 & 0 & 0 & 0 & 0 \\
0 & 0 & 0 & 0 & 0 & 0 & 0 & 0 & 1 & 1 & 1 & 1 & 0 & 0 & 0 & 0 \\
0 & 0 & 0 & 0 & 0 & 0 & 0 & 0 & 1 & -1 & 1 & -1 & 0 & 0 & 0 & 0 \\
0 & 0 & 0 & 0 & 0 & 0 & 0 & 0 & 1 & 1 & -1 & -1 & 0 & 0 & 0 & 0 \\
0 & 0 & 0 & 0 & 0 & 0 & 0 & 0 & 1 & -1 & -1 & 1 & 0 & 0 & 0 & 0 \\
0 & 0 & 0 & 0 & 0 & 0 & 0 & 0 & 0 & 0 & 0 & 0 & 1 & 1 & 1 & 1 \\
0 & 0 & 0 & 0 & 0 & 0 & 0 & 0 & 0 & 0 & 0 & 0 & 1 & -1 & 1 & -1 \\
0 & 0 & 0 & 0 & 0 & 0 & 0 & 0 & 0 & 0 & 0 & 0 & 1 & 1 & -1 & -1 \\
0 & 0 & 0 & 0 & 0 & 0 & 0 & 0 & 0 & 0 & 0 & 0 & 1 & -1 & -1 & 1
\end{bmatrix}$$

(4–ORDER) (4–ORDER) (16–ORDER)

FIG. 12

$$
\begin{bmatrix}
\boxed{a_{1,1}\ a_{1,2}\ldots a_{1,16}} & & \cdots & 0 \\
 & \boxed{a_{1,1}\ a_{1,2}\ldots a_{1,16}} & \cdots & 0 \\
0 & & & \\
 & & \vdots & \vdots \\
\vdots & \vdots & & \\
 & & & \boxed{a_{1,1}\ a_{1,2}\ldots a_{1,16}} \\
0 & 0 & \cdots & \\
 & 0 & \cdots & 0 \\
\boxed{a_{1,1}\ a_{1,2}\ldots a_{1,16}} & & & \\
 & \boxed{a_{1,1}\ a_{1,2}\ldots a_{1,16}} & \cdots & 0 \\
0 & & & \\
\vdots & \vdots & \vdots & \vdots \\
0 & 0 & \cdots & \boxed{a_{1,1}\ a_{1,2}\ldots a_{1,16}} \\
 & 0 & \cdots & 0 \\
\boxed{a_{1,1}\ a_{1,2}\ldots a_{1,16}} & & & \\
 & \boxed{a_{1,1}\ a_{1,2}\ldots a_{1,16}} & \cdots & 0 \\
0 & & & \\
\vdots & \vdots & \vdots & \vdots \\
0 & 0 & \cdots & \boxed{a_{16,1}\ a_{16,2}\ldots a_{16,16}}
\end{bmatrix}
$$

FIG. 14

$$
\begin{array}{ccccc}
10 & & 20 & & 50 \quad 30 \\
\begin{bmatrix}
1 & -1 & 1 & -1 & \cdots & 0 & 0 & 0 & 0 & 0 & 0 & 0 & 0 \\
-1 & -1 & -1 & 1 & \cdots & 0 & 0 & 0 & 0 & 0 & 0 & 0 & 0 \\
1 & -1 & 1 & 1 & \cdots & 0 & 0 & 0 & 0 & 0 & 0 & 0 & 0 \\
-1 & 1 & 1 & 1 & \cdots & 0 & 0 & 0 & 0 & 0 & 0 & 0 & 0 \\
\vdots & & & & & & & \vdots & & & & & \\
0 & 0 & 0 & 0 & \cdots & 1 & -1 & 1 & -1 & 1 & -1 & 1 & -1 \\
0 & 0 & 0 & 0 & \cdots & -1 & -1 & -1 & 1 & 1 & 1 & 1 & -1 \\
0 & 0 & 0 & 0 & \cdots & 1 & -1 & 1 & 1 & 1 & 1 & -1 & 1 \\
0 & 0 & 0 & 0 & \cdots & -1 & 1 & 1 & 1 & 1 & -1 & 1 & 1 \\
0 & 0 & 0 & 0 & \cdots & 1 & 1 & 1 & 1 & -1 & 1 & 1 & -1 \\
0 & 0 & 0 & 0 & \cdots & -1 & 1 & 1 & -1 & 1 & 1 & -1 & -1 \\
0 & 0 & 0 & 0 & \cdots & 1 & 1 & -1 & 1 & 1 & -1 & -1 & -1 \\
0 & 0 & 0 & 0 & \cdots & -1 & -1 & 1 & 1 & -1 & -1 & -1 & -1
\end{bmatrix}
&
\begin{bmatrix}
-1 & 1 \\
1 & 1 \\
-1 & 1 \\
1 & 1 \\
\vdots & \vdots \\
-1 & 1 \\
1 & 1 \\
1 & 1 \\
1 & 1 \\
1 & 1 \\
1 & 1 \\
1 & 1 \\
1 & 1
\end{bmatrix}
&=
&
\begin{bmatrix}
(1) & -8 & (249) & 0 \\
(2) & -2 & (250) & 0 \\
(3) & 0 & (251) & 4 \\
(4) & 0 & (252) & 4 \\
 & & & \vdots \\
(241) & 2 & (489) & 0 \\
(242) & 2 & (490) & 0 \\
(243) & 2 & (491) & 4 \\
(244) & 6 & (492) & 4 \\
(245) & 2 & (493) & 4 \\
(246) & 2 & (494) & 0 \\
(247) & -2 & (495) & 0 \\
(248) & -2 & (496) & -4
\end{bmatrix}
\\
 & & & & 60 \quad 60
\end{array}
$$

FIG. 20
PRIOR ART

METHOD AND APPARATUS FOR DRIVING A PASSIVE MATRIX LIQUID CRYSTAL DISPLAY DEVICE

This application is a continuation of application Ser. No. 08/418,581, filed Apr. 6, 1995, now abandoned.

FIELD OF THE INVENTION

This invention relates to a method and an apparatus for driving a passive matrix liquid crystal display device.

BACKGROUND OF THE INVENTION

Recently, a display device is indispensable as a man-machine interface, and among this kind of display devices, a liquid crystal display device is superior since it is thin, lightweight, low in power consumption, and color-pictured. Among them, a passive matrix liquid crystal display device is used widely because the price and so forth are within the range of acceptance.

Conventionally, a passive matrix liquid crystal display device is driven by ALT PLESHKO Technique which conducts line-at-a-time scanning of scanning lines. This method is described in detail in "Scanning Limitations of Liquid-Crystal Display, ALT P. M. and Pleshko P., IEEE Trans. Ed. Vol. ED 21, pp 146–155 (1974)". However, when this method is applied to a high-speed response liquid crystal panel, on-state brightness drops due to a frame response, so that contrast deteriorates. Therefore, for preventing this kind of contrast deterioration, a driving method proposed lately does not conduct line-at-a-time scanning, but selects a total number or a plurality of scanning lines simultaneously.

In the following, the driving method of selecting a total number or a plurality of scanning lines simultaneously will be explained. When liquid-crytal drive is perceived mathematically, it can be shown as Formula 1 below.

$$Y=M\cdot X \qquad \text{(Formula 1)}$$

In Formula 1 mentioned above, X represents a matrix of picture image data, and on-state is indicated as "−1", while off-state is indicated as "1". Furthermore, M represents a matrix of scan data, and a selected condition is indicated as either "1" or "−1", while a non-selected condition is indicated as "0". Then, Y which is operated by this Formula 1 becomes a matrix of signal data. However, for the signal data to be in proportion to the picture image data, the matrix of scan data M needs to be an orthogonal matrix.

Here, when each element in the matrix of scan data M is indicated as m, each element in the matrix of picture image data X is indicated as x, and each element in the matrix of signal data Y is indicated as y, signal data $y_{ij}$ of an (i, j) pixel within one frame is shown as Formula 2 below.

$$y_{ij} = \sum_{t=1}^{N} m_{it} \cdot x_{tj} \qquad \text{(Formula 2)}$$

In Formula 2 mentioned above, N represents a total number of rows in the matrix of picture image data X, and t represents time.

In addition, when voltage for one level in the matrix of signal data Y is indicated as $V_b$ and k as a constant, voltage on scan side $V_r$ to the (i, j) pixel within one frame is shown as Formula 3 below.

$$Vr=km_{ti}\cdot Vb \qquad \text{(Formula 3)}$$

Moreover, voltage on signal side $V_c$ to the (i, j) pixel within one frame is shown as Formula 4 below.

$$Vc=y_{ti}\cdot Vb \qquad \text{(Formula 4)}$$

By using the above-mentioned Formula 1, Formula 2, Formula 3, and Formula 4, applied effective voltage $V_{ij}$ to the (i, j) pixel can be obtained as shown in Formula 5 below.

$$\begin{aligned} V_{ij}^2 &= \frac{1}{N}\sum_{t=1}^{N}(Vr - Vc)^2 \\ &= \frac{S}{N}Vb^2\left(k^2 - 2kx_{ij} + \sum_{t=1}^{N} xtj^2\right) \end{aligned} \qquad \text{(Formula 5)}$$

In Formula 5 mentioned above, N represents a total number of rows in the matrix of picture image X; S represents a number of elements besides "0" in an optional row of the matrix of scan data M (hereinafter referred to as a "number of simultaneously selected lines"); and t represents time. According to Formula 5, when total elements in the matrix of picture image data X are either "1" or "−1", as shown in Formula 6 below, the third term in Formula 5 becomes a total number of rows N (constant) in the matrix of picture image data X, and dependency of an element $x_{ij}$ in the matrix of (i, j) picture image data upon the applied effective voltage $V_{ij}$ will be the second term in Formula 6 only, so that effective voltage in proportion to the element $x_{ij}$ in the matrix of (i, j) picture image date will be applied.

$$V_{ij}^2 = \frac{S}{N}Vb^2(k^2 - 2kx_{ij} + N) \qquad \text{(Formula 6)}$$

In the following, a method of driving a liquid crystal display device will be explained by means of the above-mentioned conventional driving method of selecting a total number or a plurality of scanning lines simultaneously.

FIG. 20 is a drawing which shows a display operation method in the conventional driving method of selecting a total number or a plurality of scanning lines simultaneously. In this figure, reference numeral 10 represents a matrix of scan data; 20 represents a matrix of picture image data; 30 represents a matrix of signal data; 50 represents a maximum value of signal data; and 60 represents an operation order. As an example used here is the matrix of scan data 10 in 248-order which is a circulant Hadamard matrix in eight-order shown in Formula 7 below (a number of simultaneously selected lines S=8) having inverted signs for each row and each column and being extented by Kronecker product with a unit matrix in 31-order.

$$H = \begin{bmatrix} 1 & -1 & 1 & -1 & 1 & -1 & 1 & -1 \\ -1 & -1 & -1 & 1 & 1 & 1 & 1 & -1 \\ 1 & -1 & 1 & 1 & 1 & 1 & -1 & 1 \\ -1 & 1 & 1 & 1 & 1 & -1 & 1 & 1 \\ 1 & 1 & 1 & 1 & -1 & 1 & 1 & -1 \\ -1 & 1 & 1 & -1 & 1 & 1 & -1 & -1 \\ 1 & 1 & -1 & 1 & 1 & -1 & -1 & -1 \\ -1 & -1 & 1 & 1 & -1 & -1 & -1 & -1 \end{bmatrix} \qquad \text{(Formula 7)}$$

Furthermore, the matrix of picture image data comprises 240 rows and 2 columns (N=240), and each element in the first column is "−1" and "1" being repeated from the first row to the N row, and "−1" is inserted as dummy data into the (N+1) row and "1" from the (N+2) row to the (N+8) row.

In the second column, "1" is inserted totally from the first row to the N row, and dummy data of "1" is inserted from the (N+1) row to the (N+8) row. Accordingly, the matrix of picture image data 20 is comprised of 248 rows and 2 columns as a whole. In this case, the matrix of signal data 30 is constructed by an operation in an order shown in the operation order 60. Also, the signal data reaches the maximum when each element in the row of the matrix of scan data 10 and each element in the column of the matrix of picture image data 20 conform completely, and this value is "8".

Next, a configuration of a conventional apparatus for driving a passive matrix liquid crystal display device will be explained which can be applied to the conventional driving method of selecting a total number or a plurality of scanning lines simultaneously by means of the above-mentioned operation method. Also, its operation will be explained.

FIG. 21 is a block diagram showing a conventional apparatus for driving a passive matrix liquid crystal display device. As shown in FIG. 21, the conventional apparatus for driving a passive matrix liquid crystal display device is comprised of a field memory of picture image data 70 for storing picture image data being input from outside; a readout circuit of picture image data 71 for reading out each element in a specific column of a matrix of picture image data; a memory of scan data 80 for storing scan data in advance; a readout circuit of scan data 81 for reading out specific scan data from the memory of scan data 80; an operation circuit of each element 90 for operating a matrix of signal data Y based on picture image data in a specific column being read out from the field memory of picture image data 70 and also based on scan data being read out from the memory of scan data 80; a field memory of signal data 100 for storing data after being operated; a readout circuit of signal data 101 for reading out operated signal data from the field memory of signal data 100; a driver on scan side 110; a D/A converter 120 for converting the read-out data signals from digital signals to analog signals; a driver on signal side 130; a passive matrix liquid crystal display device 140; and a frame reducing controller 150 for controlling gradation (hereinafter referred to as a "FRC").

After picture image data being input from outside is input into the FRC 150, gradation control is conducted by the FRC 150. The picture image data performed with the gradation control is once stored in the field memory of picture image data 70. Then, each element in the first column of the matrix of picture image data 20 is read out by the readout circuit of picture image data 71, which is then operated by the operation circuit 90 by using scan data being stored in the memory of scan data 80 and by solving Formula 1 mentioned above. At this time, each element in the matrix of scan data 10 is read out in order from the first row to the 248th row by the readout circuit of scan data 81. This operation is conducted in the similar manner in the second column of the matrix of picture image data 20.

After being operated, the data is output according to the operation order 60 shown in FIG. 20 and then stored in the field memory of signal data 100. Next, the data is read out by the readout circuit of signal data 101 in the order of transfer to the driver on signal side 130, and after being converted from digital signals to analog signals by the D/A converter 120, the data is transferred to the driver on signal side 130. The driver on signal side 130 applies voltage in accordance to the analog signal data being input to an electrode on signal side in the passive matrix liquid crystal display device 140. On the other hand, on scan side, the operated data is stored in the memory of scan data 80, and each element in the matrix of scan data is read out in order from the first row to the 248th row by the readout circuit of scan data 81, which is then transferred to the driver on scan side 110. The driver on scan side 110 applies voltage in accordance to the scan data being input to an electrode on scan side in the passive matrix liquid crystal display device 140.

According to the method mentioned above, by increasing a number of simultaneously selected lines (a number of scanning lines being selected) and dispersing effective voltage which is imposed on each pixel within one frame, a frame response in a high-speed liquid crystal is suppressed, so contrast can be improved. This method is described more in detail in "Hardware Architectures for Video Rate, Active Addressed STN Displays, B. Clifton etc. JAPAN DISPLAY'92 pp. 504–506".

However, in order to make the applied effective voltage $V_{ij}$ to the (i, j) pixel to be in proportion to the element $x_{ij}$ in the matrix of (i, j) picture image data as mentioned above, each element x in the matrix of picture image data must be conditioned to be either totally "1" or "−1". The reason is that if each element x in the matrix of picture image data were not totally "1" or "−1", the third term in Formula 4 mentioned above would not be a constant. Therefore, when each element x in the matrix of picture image data is in the range of "−1" to "1" and performs a gradation display having a value besides "1" and "−1", the third term in Formula 4 is not a constant, but becomes a term dependent upon each element x in the matrix of picture image data, similar to the second term. Thus, the applied effective voltage $V_{ij}$ to the (i, j) pixel is no longer in proportion to the element $x_{ij}$ in the matrix of (i, j) picture image data. As mentioned above, in the conventional driving method of selecting a total number or a plurality of scanning lines simultaneously, a gradation control by a pulse height of the applied voltage can not be conducted, so that for a gradation display, it was necessary to conduct a gradation control by a frame rate control method (hereinafter referred to as a "FRC system"). As a result, the quality of display was ruined due to flickers occuring in the image plane. Another problem as follows arises when a circulant Hadamard matrix is used as a matrix of scan data.

FIG. 19 shows an example of a waveform of applied voltage in liquid crystal and a waveform of an optic response in liquid crystal, provided that a circulant Hadamard matrix consisting of 420 rows and 420 columns having signs reversed for every row and for every column is used, and that data at on-state is included in the column direction of a matrix of picture image data, and that an abscissa at the display of off-state indicates time. At this time, however, a response speed of the liquid crystal was 150 msec for rising and decaying in average. In this figure, reference numeral 222 represents an observed waveform of an optic response in liquid crystal; 223 represents an ideal waveform under the same conditions; 210, 211 represent ground; and 224 represents a waveform of applied voltage to liquid crystal. In this case, the observed waveform of an optic response in liquid crystal 222 shows negative electrode property against the ground 210.

In addition, FIG. 18 shows an example of a waveform of applied voltage in liquid crystal and a waveform of an optic response in liquid crystal, provided that a circulant Hadamard matrix consisting of 420 rows and 420 columns having signs reversed for every row and for every column is used, and that only data at off-state is present in the column direction of a matrix of picture image data, and that an abscissa at the display of off-state indicates time. A response speed of the liquid crystal was 150 msec for rising and decaying in average. In this figure, reference numeral 218 represents an observed waveform of an optic response in liquid crystal; 219 represents an ideal waveform under the same conditions; 220 represents a pulsative response part; and 221 represents a waveform of applied voltage to liquid crystal. In FIG. 18, the same reference numerals are given to the parts which are identical to those in FIG. 19, and the explanation is omitted. Also in this case, the observed waveform of an optic response in liquid crystal 218 shows negative electrode property against the ground 210.

As shown in FIG. 18, it is clear that a periodic change of low frequency can be observed in the waveform of applied voltage to liquid crystal 221, and that the observed waveform of an optic response in liquid crystal 218 has the pulsative response part 221 when a display at off-state is performed, and that brightness has enhanced against the ideal waveform 219. In FIG. 19, on the other hand, although a pulsative response part can be observed in the observed waveform of an optic response in liquid crystal 222, the degree is small, so the waveform has become closer to the ideal off-brightness.

Accordingly, when the circulant Hadamard matrix having signs reversed at an equal rate as shown in Formula 7 above is used, cross-talk occurs due to a difference in brightness at offstage caused by the content of the picture image data. Furthermore, there was a problem that since the off-brightness does not drop, the contrast does not improve as well.

Incidentally, when a matrix of signal data is operated by using a matrix of scan data which is an orthogonal matrix consisting of three values of "1", "0", and "−1", among these orthogonal matrixes with three values, a displayed picture image having higher contrast can be obtained by using a matrix T' shown as Formula 9 below, rather than using a matrix T shown as Formula 8 below.

$$T = \begin{bmatrix} 1 & 1 & 0 & 0 & 0 & 0 & 0 & 0 \\ 1 & -1 & 0 & 0 & 0 & 0 & 0 & 0 \\ 0 & 0 & 1 & 1 & 0 & 0 & 0 & 0 \\ 0 & 0 & 1 & -1 & 0 & 0 & 0 & 0 \\ 0 & 0 & 0 & 0 & 1 & 1 & 0 & 0 \\ 0 & 0 & 0 & 0 & 1 & -1 & 0 & 0 \\ 0 & 0 & 0 & 0 & 0 & 0 & 1 & 1 \\ 0 & 0 & 0 & 0 & 0 & 0 & 1 & -1 \end{bmatrix} \quad \text{(Formula 8)}$$

$$T' = \begin{bmatrix} 1 & 1 & 0 & 0 & 0 & 0 & 0 & 0 \\ 0 & 0 & 1 & 1 & 0 & 0 & 0 & 0 \\ 0 & 0 & 0 & 0 & 1 & 1 & 0 & 0 \\ 0 & 0 & 0 & 0 & 0 & 0 & 1 & 1 \\ 1 & -1 & 0 & 0 & 1 & 1 & 0 & 0 \\ 0 & 0 & 1 & -1 & 0 & 0 & 0 & 0 \\ 0 & 0 & 0 & 0 & 1 & -1 & 0 & 0 \\ 0 & 0 & 0 & 0 & 0 & 0 & 1 & -1 \end{bmatrix} \quad \text{(Formula 9)}$$

The matrix T shown as Formula 8 above can be obtained by extending an orthogonal matrix S consisting of two values of "1" and "−1" as shown in Formula 10 below (hereinafter referred to as a "sub matrix") by Kronecker product shown in Formula 12 below with the use of a unit matrix I shown as Formula 11.

$$S = \begin{bmatrix} 1 & 1 \\ 1 & -1 \end{bmatrix} \quad \text{(Formula 10)}$$

$$I = \begin{bmatrix} 1 & 0 & 0 & 0 \\ 0 & 1 & 0 & 0 \\ 0 & 0 & 1 & 0 \\ 0 & 0 & 0 & 1 \end{bmatrix} \quad \text{(Formula 11)}$$

$$A \times B = \begin{bmatrix} a_{11}B & a_{12}B & \dots & a_{1m}B \\ a_{21}B & a_{22}B & \dots & a_{2m}B \\ \vdots & \vdots & & \\ a_{m1}B & a_{m2}B & \dots & a_{mm}B \end{bmatrix} \quad \text{(Formula 12)}$$

$$A[a_{ij}](i, j = 1, 2 \dots, m)$$

Also, the matrix T' shown as Formula 9 above can be obtained by using i and i' obtained by Formula 13 below and by changing the i row in the matrix T shown as Formula 8 above to the i' row.

$$i = r \times n + s + 1$$

$$i' = s \times m + r + 1 \quad \text{(Formula 13)}$$

(i, i': a natural number less than or equal to N; r: an integral number greater than or equal to 0, and less than m; s: an integral number greater than or equal to 0, and less than m) In Formula 13 mentioned above, n represents a degree of the sub matrix S, and m represents a degree of the unit matrix I.

The reason why the above-mentioned difference of contrast occurs is as follows. Namely, since the longitudinal direction of a matrix of scan data 301 shown in FIG. 11, which is a drawing showing the relationship with a liquid crystal panel, corresponds to the time direction, an interval between one selective period of 1, −1 to the next selective period of 1, −1 is longer in the matrix T shown as Formula 8 above than the matrix T' shown as Formula 9 above, so that the same phenomenon as a frame response occurs.

As mentioned above, a matrix of scan data used conventionally was a matrix which can be produced by an easy operation of extending and expanding an optional sub matrix S having two value elements of "1" and "−1" to a degree which is suitable for a matrix size of picture image data with the use of an optional unit matrix I.

In this case, however, irregularity occurs in correspondence with the sub matrix S to the applied voltage of a scanning line as a unit to a liquid crystal display. As a result, an optic response in liquid crystal becomes irregular, which leads to course-marked contrast patterns in the displayed picture image, so the quality of display was ruined.

SUMMARY OF THE INVENTION

It is an object of this invention to solve the above-noted problems in the conventional system by providing a method and an apparatus for driving a passive matrix type liquid crystal display device which can display high-quality gradation through reduction of cross talk and improvement of contrast. Another object of this invention is to provide a method for driving a passive matrix liquid crystal display device which can perform a high-quality display through reduction of course-marked contrast patterns in the displayed picture image.

In order to accomplish these and other objects and advantages, an apparatus for driving a liquid crystal display device of this invention comprises at least a storing means of picture image data for storing picture image data which is input from outside; a readout means of picture image data for reading out each element in a specific column of a matrix of picture image data from the storing means of picture image data; a calculation means of a gradation correction term for calculating a gradation correction term from the read-out picture image data; a storing means of scan data for storing scan data in advance; a readout means of scan data for reading out specific scan data from the storing means of scan data, an operation means for operating a matrix of signal data based on the picture image data in a specific column being read out from the storing means of picture image data, scan data being read out from the storing means of scan data, and the gradation correction term; and a storing means of signal data for storing signal data after being operated.

It is preferable that the picture image data and the scan data respectively comprise matrixes, and the calculation means of a gradation correction term inserts a gradation correction term in the last row of the matrix of picture image data.

Furthermore, it is preferable that the picture image data and the scan data respectively comprise matrixes, and the calculation means of a gradation correction term inserts a gradation correction term for every predetermined row in the matrix of picture image data. Also, it is preferable that the storing means of picture image data and the storing means of signal data comprise line memories.

In addition, it is preferable that the storing means of picture image data and the storing means of signal data comprise field memories.

A first configuration of a method for driving a passive matrix liquid crystal display device of this invention comprises the steps of generating a matrix of signal data by operating a matrix of picture image data being input from outside with a matrix of scan data; applying voltage to scanning electrodes in correspondence to the matrix of scan data; and applying voltage to signal electrodes in correspondence to the matrix of signal data, wherein the matrix of scan data used is an orthogonal matrix, and gradation is displayed by correcting gradation with the matrix of picture image data within one frame.

Furthermore, it is preferable that gradation is corrected once within one frame, and a number of picture image data for calculation of gradation correction value comprises a total number of rows in the matrix of picture image data.

In addition, it is preferable that gradation is corrected for a plurality of times within one frame, and a number of picture image data for calculation of gradation correction value is less than a total number of rows in the matrix of picture image data.

Also, it is preferable that the number of picture image data for calculation of gradation correction value is one less than the number of elements, other than 0, in an optional row of the matrix of scan data, and a frequency of conducting gradation correction within one frame is a value being divided with a number of elements besides 0 in an optional row of the matrix of scan data.

It is preferable that the number of picture image data for calculation of the gradation correction value is one less than the number of elements in an optional row of the matrix of scan data other than 0, multiplied by an integral number, and a frequency of conducting gradation correction within one frame is a value, which is a total number of rows being divided with a number of elements in an optional row of the matrix of scan data other than 0, multiplied by an integral number.

Furthermore, it is preferable that the matrix of picture image data being input from outside is first stored in a storing element of the input part and then operated with the matrix of scan data, and the operation is conducted in the order of transfer to a driver on signal side.

In addition, it is preferable that the matrix of picture image data being input from outside is first stored in a storing element of the input part and then operated with the matrix of scan data. The matrix of signal data is then stored in a storing element of the output part, and the signal data is transferred.

Also, it is preferable that the matrix of scan data used is an orthogonal matrix, which is a matrix being expanded with a unit matrix by Kronecker product, wherein the matrix comprises either "1" or "−1" as each element, does not include a row or a column consisting only of one value element selected from "1" and "−1", and does not include a row or a column having "1" and "−1" arranged in turn at an equal rate.

It is preferable that the matrix of scan data used is an orthogonal matrix, which is a matrix being expanded with a unit matrix by Kronecker product, wherein the matrix is produced by reversing signs irregularly in a normal form Hadamard matrix in-order (n is a natural number) each element comprising either "1" or "−1".

A second configuration of a method for driving a passive matrix liquid crystal display device of this invention comprises the steps of generating a matrix of signal data by operating a matrix of picture image data being input from outside with a matrix of scan data, applying a voltage to row electrodes in correspondence to the matrix of scan data, and applying voltage to column electrodes in correspondence to the matrix of signal data, wherein the matrix of scan data is an optional orthogonal matrix comprising two value elements of "1" and "−1" being expanded with a unit matrix by Kronecker product, and after a non-0 element part is expanded stepwise in order to shorten an interval between each selective period, integral numbers j and k having values of two and more are used for dividing the matrix into k equal parts in the row direction (a column degree is divided into k) and into j equal parts in the column direction (a row degree is divided into j), thereby dividing it into k×j pieces of 1/(k×j) partial matrixes, and j pieces of 1/(k×j) partial matrixes are replaced in an optional order within each of k pieces of column division as a unit, and the matrix of signal data is operated based on this matrix of scan data.

Furthermore, it is preferable that the matrix of scan data is divided into two equal parts in the row direction and in the column direction respectively, and the partial matrixes are replaced between a ¼ partial matrix positioned in the latter half of the row and in the former half of the column and a ¼ partial matrix positioned in the latter half of the row and in the latter half of the column.

In addition, it is preferable that the matrix of scan data is divided into two equal parts in the row direction and in the column direction respectively, and the partial matrixes are replaced between a ¼ partial matrix positioned in the former half of the row and in the former half of the column and a ¼ partial matrix positioned in the former half of the row and in the latter half of the column.

A third configuration of a method for driving a passive matrix liquid crystal display device of this invention comprises the steps of generating a matrix of signal data by operating a matrix of picture image data being input from outside with a matrix of scan data, applying voltage to row electrodes in correspondence to the matrix of scan data, and applying voltage to column electrodes in correspondence to the matrix of signal data, wherein the matrix of scan data is an optional sub matrix comprising two value elements of "1" and "−1" which averages a frequency difference of switching between "1" and "−1" in each adjacent column element being expanded with a unit matrix by Kronecker product, and after a non-0 element part is expanded stepwise in order to shorten an interval between each selective period, integral numbers j and k having values of two and more are used for dividing the matrix into k equal parts in the row direction (a column degree is divided into k) and into j equal parts in the column direction (a row degree is divided into j), thereby dividing it into k×j pieces of 1/(k×j) partial matrixes, and j pieces of 1/(k×j) partial matrixes are replaced in an optional order within each of k pieces of column division as a unit, and the matrix of signal data is operated based on this matrix of scan data.

According to the configuration of the apparatus of this invention, it comprises at least a storing means of picture image data for storing picture image data which is input from outside; a readout means of picture image data for reading out each element in a specific column of a matrix of picture image data from the storing means of picture image data; a calculation means of gradation correction term for calculating a gradation correction term from the read-out picture image data; a storing means of scan data for storing scan data in advance; a readout means of scan data for reading out specific scan data from the storing means of scan data; an operation means for operating a matrix of signal data based on the picture image data in a specific column being read out from the storing means of picture image data, scan data being read out from the storing means of scan data, and the gradation correction term; and a storing means of signal data for storing signal data after being operated. As a result, the apparatus has the following effects. Namely, in this apparatus, a picture image data being input from outside is once stored in the storing means of picture image data, and at the same time, each element of a specific column in the matrix of picture image data is read out by the readout means of picture image data. The calculation means of gradation correction term calculates a gradation correction term from the read-out picture image data. On the other hand, the readout means of scan data reads out specific scan data from the scan data which has been stored in advance in the storing means of scan data. The operation means operates a matrix of signal data based on the picture image data of a specific column being read out from the storing means of picture image data, scan data being read out from the storing means of scan data, and the gradation correction term. Each means mentioned above comprises, for example, a widely known microprocessor, ROM, RAM, and so forth. Therefore, it is no longer necessary to control gradation by means of a system of thinning binary value data for each frame (FRC), which was conventionally performed before storing in the storing means of picture image data, and flickering in the image plane does not occur, so that the quality of display in the liquid crystal display device is not ruined.

Furthermore, according to the configuration of the apparatus of this invention, the picture image data and the scan data comprise matrixes respectively, and the calculation means of gradation correction term inserts a gradation correction term in the last row of the matrix of picture image data. As a result, the applied effective voltage is in proportion to the element in the matrix of picture image data, and it is possible to control gradation by a peak value of the applied voltage without using the system of thinning binary value data for each frame. In this way, by using a method of driving which selects a total number or a plurality of scanning lines simultaneouly, the gradation display in the passive matrix liquid crystal display device can attain higher quality.

In addition, when the picture image data and the scan data respectively comprise matrixes, and the calculation means of gradation correction term inserts a gradation correction term for every predetermined row in the matrix of picture image data, the gradation correction term can be determined plurally, and the maximum value of gradation correction term can become smaller, so that the maximum value of signal data can become smaller. Thus, also at the time of gradation display, a peak value of voltage in electrodes on signal side can be controlled to be low. Furthermore, when this method is compared with a conventional driving method, a peak value of voltage in electrodes on signal side can be controlled to be low, so that power consumption can be reduced. Moreover, since the gradation correction can be conducted by dividing for every predetermined row, the number of picture image data for calculation of gradation correction value is reduced, and thus, a capacity of memory needed for operation can be reduced. In this case, when the storing means of picture image data and the storing means of signal data comprise line memories, power consumption can be lowered and cost reduction can be enhanced even more.

In the above-mentioned configuration, it is preferable that the storing means of picture image data and the storing means of signal data comprise field memories. In this way, gradation correction can be conducted for each frame, so that operation processing time can be shortened.

Furthermore, according to the first configuration of the method of this invention, it comprises the steps of generating a matrix of signal data by operating a matrix of picture image data being input from outside with a matrix of scan data, applying voltage to scanning electrodes in correspondence to the matrix of scan data, and applying voltage to signal electrodes corresponding to the matrix of signal data, wherein the matrix of scan data used is an orthogonal matrix, and gradation is displayed by correcting gradation with the matrix of picture image data within one frame. Therefore, it is no longer necessary to control gradation by means of a system of thinning binary value data for each frame (FRC), which was conventionally performed before storing in the storing means of picture image data. Flickering in the image plane does not occur any more, so that the quality of display in the liquid crystal display device is not ruined.

Furthermore, it is preferable that gradation is corrected once within one frame, and a number of picture image data for calculation of gradation correction value comprises a total number of rows in the matrix of picture image data. In this way, the gradation correction can be conducted for each frame, so that operation processing time can be shortened.

In addition, when gradation is corrected for a plurality of times within one frame, and a number of picture image data for calculation of gradation correction value is less than a total number of rows in the matrix of picture image data, gradation correction can be conducted by dividing for each predetermined line, so that a number of picture image data for calculation of gradation correction value is reduced. As a result, a capacity of memory needed for operation can be reduced, and power consumption can be lowered and cost reduction can be enhanced even more.

Also, it is preferable that the number of picture image data for calculation of gradation correction value is one less than the number of elements in an optional row of the matrix of scan data, other than 0, and a frequency of conducting gradation correction within one frame is a value being divided with the number of elements in an optional row of the matrix of scan data, other than 0. As a result, a gradation correction value can become smaller, and the maximum value of signal data becomes smaller as well. Thus, also at the time of gradation display, a peak value of voltage in electrodes on the signal side can be controlled to be low. Furthermore, when this method is compared with a conventional driving method, a peak value of voltage in electrodes on the signal side can be controlled to be low, so that power consumption can be further reduced.

According to the first configuration of the method of this invention, it is preferable that the number of picture image data for calculation of the gradation correction value is one less than the number of elements in an optional row in the matrix of scan data, other than 1, multiplied by an integral number, and a frequency of conducting gradation correction within one frame is a total number of rows being divided with the number of elements in an optional row of the matrix of scan data, other than 1, multiplied by an integral number. As a result, a number of picture image data for calculation of gradation correction value is reduced, and a capacity of memory needed for operation can be reduced, so that power consumption can be lowered and cost reduction can be enhanced even more.

Furthermore, when the matrix of picture image data being input from outside is first stored in a storing element of the input part and then operated with the matrix of scan data, and the operation is conducted in the order of transfer to a driver on signal side, a storing element of the output part can be omitted.

In addition, when the matrix of picture image data being input from outside is first stored in a storing element of the input part and then operated with the matrix of scan data, and after the matrix of signal data after being operated is stored in a storing element of the output part, the signal data is transferred, the operation can be conducted in an optional order, so that operation time can be shortened and power consumption can be reduced.

Also, it is preferable that the matrix of scan data used is an orthogonal matrix, which is a matrix being expanded with a unit matrix by Kronecker product, wherein the matrix comprises either "1" or "−1" as each element, does not include a row or a column consisting only of one value element selected from "1" and "−1", and does not include a row or a column having "1" and "−1" arranged in turn at an equal rate. As a result, while cross-talk drops, contrast is improved, so that a gradation display can attain higher quality.

As mentioned above, it is preferable that the matrix of scan data used is an orthogonal matrix, which is a matrix being expanded with a unit matrix by Kronecker product, wherein the matrix is produced by reversing signs irregularly in a normal form Hadamard matrix in n-order (n is a natural number) each element comprising either "1" or "−1". Thus, deterioration of contrast is controlled and cross-talk is reduced, so that a gradation display can attain higher quality.

A second configuration of the method of this invention comprises the steps of generating a matrix of signal data by operating a matrix of picture image data being input from outside with a matrix of scan data, applying voltage to row electrodes in correspondence to the matrix of scan data, and applying voltage to column electrodes in correspondence to the matrix of signal data, wherein the matrix of scan data is an optional orthogonal matrix comprising two value elements of "1" and "−1" being expanded with a unit matrix by Kronecker product, and after a non-0 element part is expanded stepwise in order to shorten an interval between each selective period, integral numbers j and k having values of two and more are used for dividing the matrix into k equal parts in the row direction (a column degree is divided into k) and into j equal parts in the column direction (a row degree is divided into j), thereby dividing it into k×j pieces of 1/(k×j) partial matrixes, and j pieces of 1/(k×j) partial matrixes are replaced in an optional order within each of k pieces of column division as a unit, and the matrix of signal data is operated based on this matrix of scan data. As a result, by replacing the partial matrixes in the matrix of scan data, omnipresence of applied voltage on the matrix of signal data side will have higher frequency in the direction of time axis. Thus, an irregular peak value of applied voltage can be controlled, which results in controlling irregularity of an optical response of liquid crystal in correspondence to this voltage, so that course-marked contrast patterns can be reduced in the displayed picture image. In this way, the quality of display can be improved.

According to the third configuration of the method of this invention, it comprises the steps of generating a matrix of signal data by operating a matrix of picture image data being input from outside with a matrix of scan data, applying voltage to row electrodes in correspondence to the matrix of scan data, and applying voltage to column electrodes in correspondence to the matrix of signal data, wherein the matrix of scan data is an optional sub matrix comprising two value elements of "1" and "−1" which averages a frequency difference of switching between "1" and "−1" in each adjacent column element being expanded with a unit matrix by Kronecker product, and after a non-0 element part is expanded stepwise in order to shorten an interval between each selective period, integral numbers j and k having values of two and more are used for dividing the matrix into k equal parts in the row direction (a column degree is divided into k) and into j equal parts in the column direction (a row degree is divided into j), thereby dividing it into k×j pieces of 1/(k×j) partial matrixes, and j pieces of 1/(k×j) partial matrixes are replaced in an optional order within each of k pieces of column division as a unit, and the matrix of signal data is operated based on this matrix of scan data. As a result, course-marked contrast patterns can be reduced in the displayed picture image, and the quality of display can be improved even more.

BRIEF DESCRIPTION OF THE DRAWINGS

FIG. 3 is a diagram showing an operation method of gradation display in a second embodiment of a method for driving a passive matrix liquid crystal display device of this invention.

FIG. 6 is a diagram showing an operation method of gradation display in a fourth embodiment of a method for driving a passive matrix liquid crystal display device of this invention.

FIG. 8 is a diagram showing an operation method of gradation display in a fifth embodiment of a method for driving a passive matrix liquid crystal display device of this invention.

FIG. 12 is a diagram showing the relationship between a sub matrix and a matrix of scan data in a seventh embodiment of a method for driving a passive matrix liquid crystal display device of this invention.

FIG. 14 is a diagram showing the deformation of a matrix of scan data for preventing a frame response in a seventh embodiment of a method for driving a passive matrix liquid crystal display device of this invention.

FIG. 20 is a diagram showing an operation method of gradation display in a conventional method for driving a passive matrix liquid crystal display device.

DETAILED DESCRIPTION OF THE INVENTION

This invention will be described in detail by referring to the following illustrative examples and attached figures. The examples are not intended to limit the invention in any way.

EXAMPLE 1

Formula 14 below shows a matrix which was used as a matrix of scan data X of this invention.

$$M = \begin{bmatrix} 1 & -1 & 1 & 1 & -1 & 1 & -1 & -1 \\ -1 & -1 & -1 & 1 & 1 & 1 & 1 & -1 \\ 1 & -1 & -1 & -1 & -1 & 1 & 1 & 1 \\ 1 & 1 & -1 & 1 & -1 & -1 & 1 & -1 \\ -1 & 1 & -1 & -1 & -1 & 1 & -1 & -1 \\ 1 & 1 & 1 & -1 & 1 & 1 & 1 & -1 \\ -1 & 1 & 1 & 1 & -1 & 1 & 1 & 1 \\ -1 & -1 & 1 & -1 & -1 & -1 & 1 & -1 \end{bmatrix} \quad \text{(Formula 14)}$$

The matrix of scan data M shown in Formula 14 above is produced by multiplying all the elements of a matrix comprising a second-order normal form Hadamard matrix shown in Formula 10 above being extended three times with this second-order normal form Hadamard matrix by a sign which is calculated by eight-order quadratic residue (hereinafter referred to as a "random reverse normal form Hadamard matrix"). Accordingly, it is possible to make regularity such as the eight-order circulant Hadamard matrix shown in Formula 7 above disappear.

Figure 2:
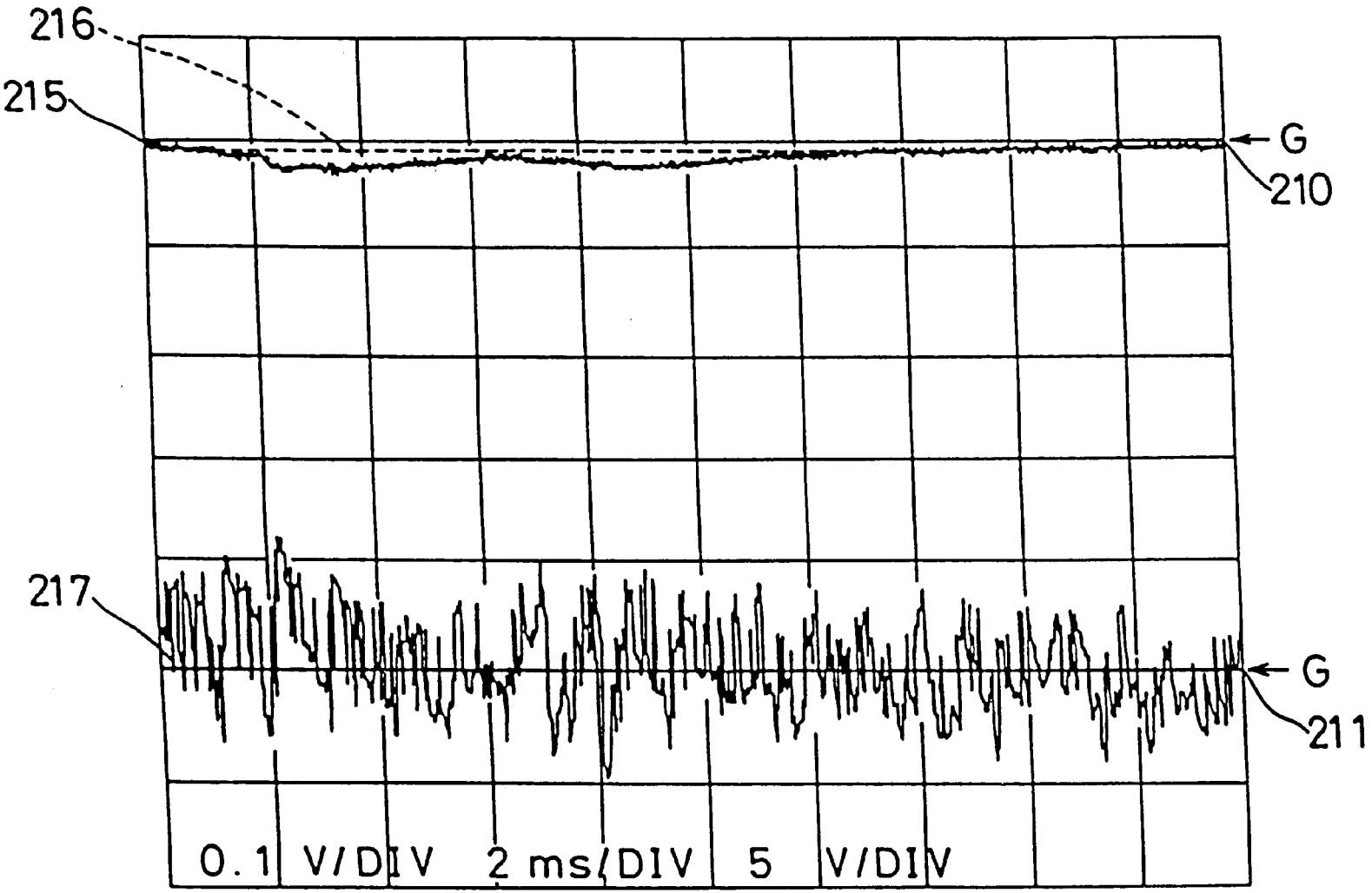
FIG. 2 is a graph showing a waveform of an optic response in liquid crystal and a waveform of applied voltage in liquid crystal for an off-state part when picture image data includes on-state data in a first embodiment of a method for driving a passive matrix liquid crystal display device of this invention.
Figure 19:
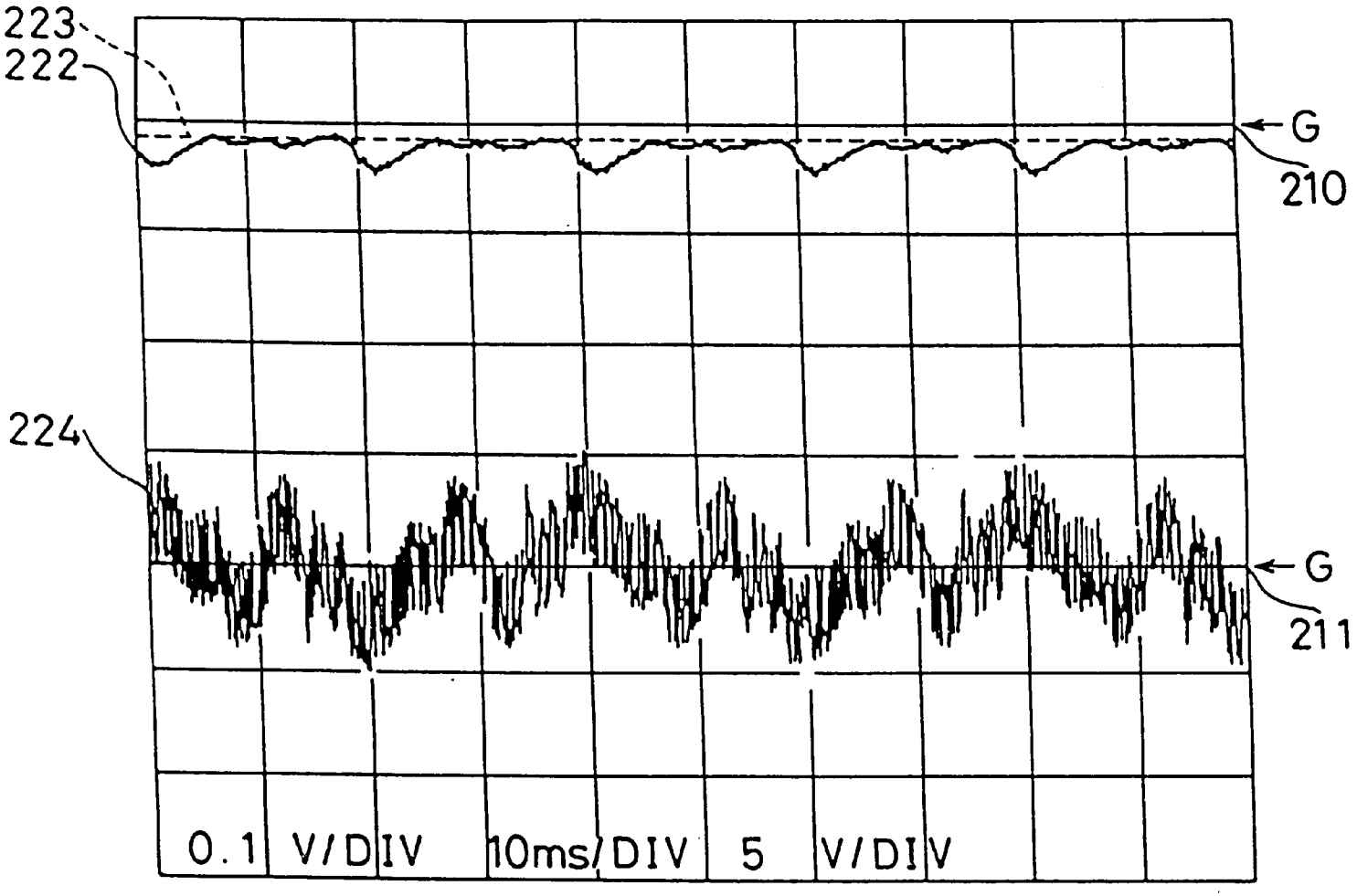
FIG. 19 PRIOR ART
FIG. 19 is a graph showing a waveform of an optic response in liquid crystal and a waveform of applied voltage in liquid crystal in a conventional method for driving a passive matrix liquid crystal display device, wherein data at on-state is included in picture image data.
Figure 21:
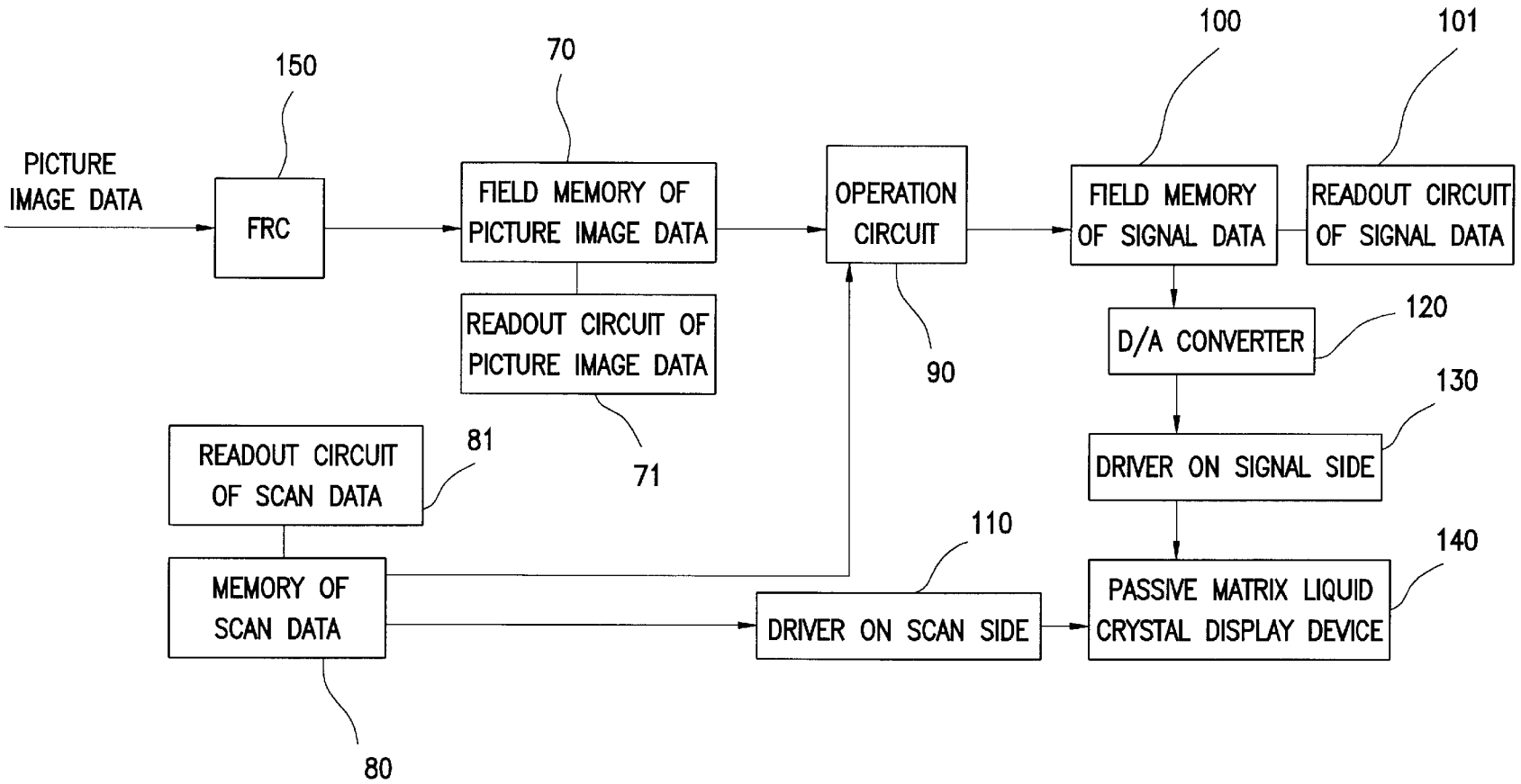
FIG. 21 PRIOR ART
FIG. 21 is a block diagram showing a conventional apparatus for driving a passive matrix liquid crystal display device.

FIG. 2 shows a waveform of applied voltage in liquid crystal and a waveform of an optic response in liquid crystal at the display of off-state, wherein a matrix of scan data used comprises a random reverse normal form Hadamard matrix consisting of 512 rows and 512 columns, a matrix of picture image data includes data at on-state in the column direction, and an abscissa shows time. At this time, however, a response speed of the liquid crystal is 150 msec for rising and decaying, on average. In this figure, reference numeral 215 represents an observed waveform of an optic response in liquid crystal; 216 represents an ideal waveform under the same conditions; and 217 represents a waveform of applied voltage to a liquid crystal. In FIG. 12, the same reference numerals are given to the parts which are identical to those in FIG. 19, and the explanation is omitted.

Figure 1:
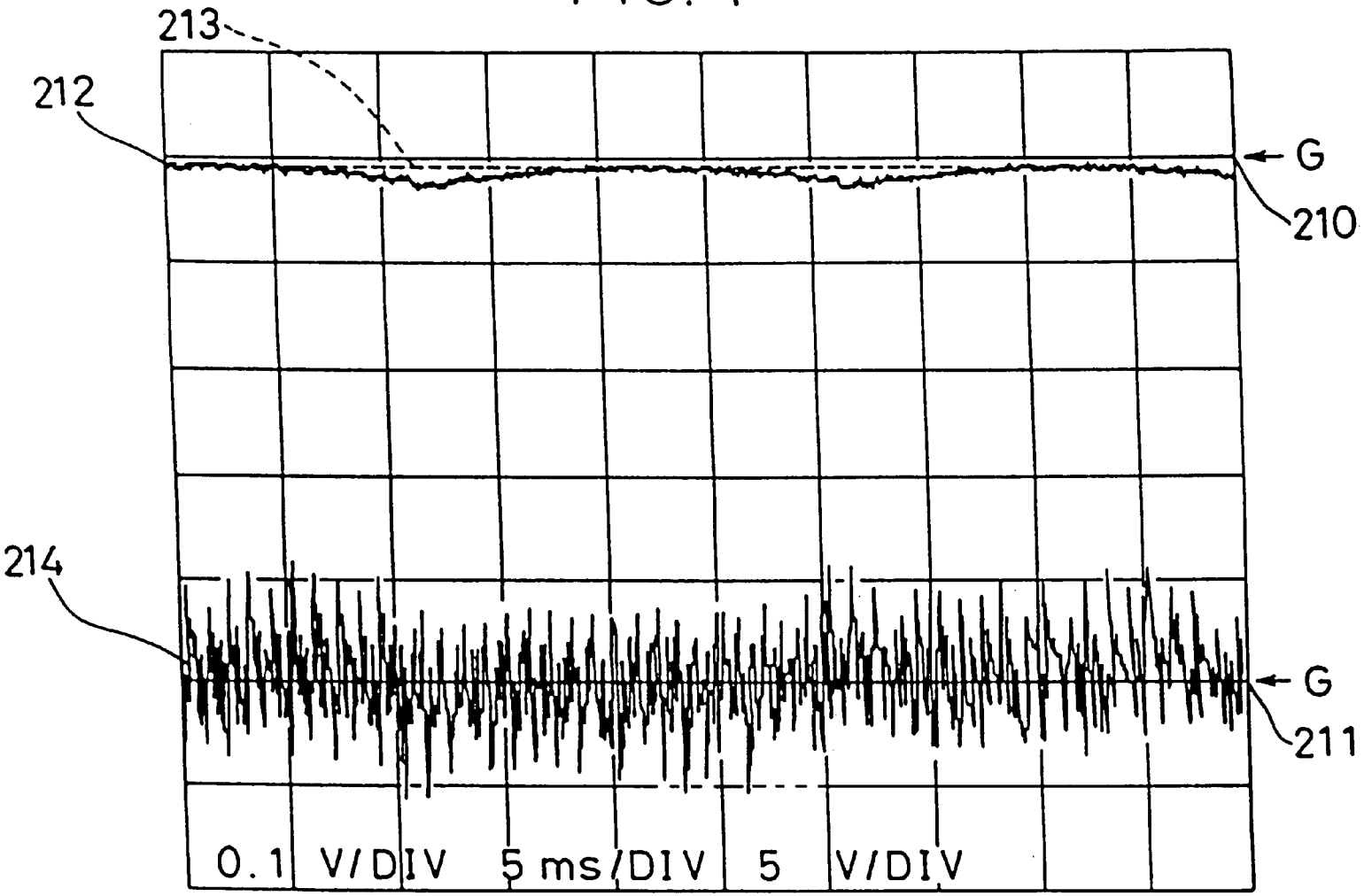
FIG. 1 is a graph showing a waveform of an optic response in liquid crystal and a waveform of applied voltage in liquid crystal for an off-state part when picture image data is only off-state data in a first embodiment of a method for driving a passive matrix liquid crystal display device of this invention.

FIG. 1 shows a waveform of applied voltage in a liquid crystal and a waveform of an optic response in the liquid crystal at the display of off-state, wherein a matrix of scan data used comprises a random reverse normal form Hadamard matrix consisting of 512 rows and 512 columns, a matrix of picture image data includes only data at off-state in the column direction, and an abscissa shows time. A response speed of the liquid crystal is 150 msec for rising and decaying on average. In this figure, reference numeral 212 represents an observed waveform of an optic response in the liquid crystal; 213 represents an ideal waveform under the same conditions; and 214 represents a applied voltage to liquid crystal. Also in FIG. 1, the same reference numerals are given to the parts which are identical to those in FIG. 19, and the explanation is omitted.

Figure 18:
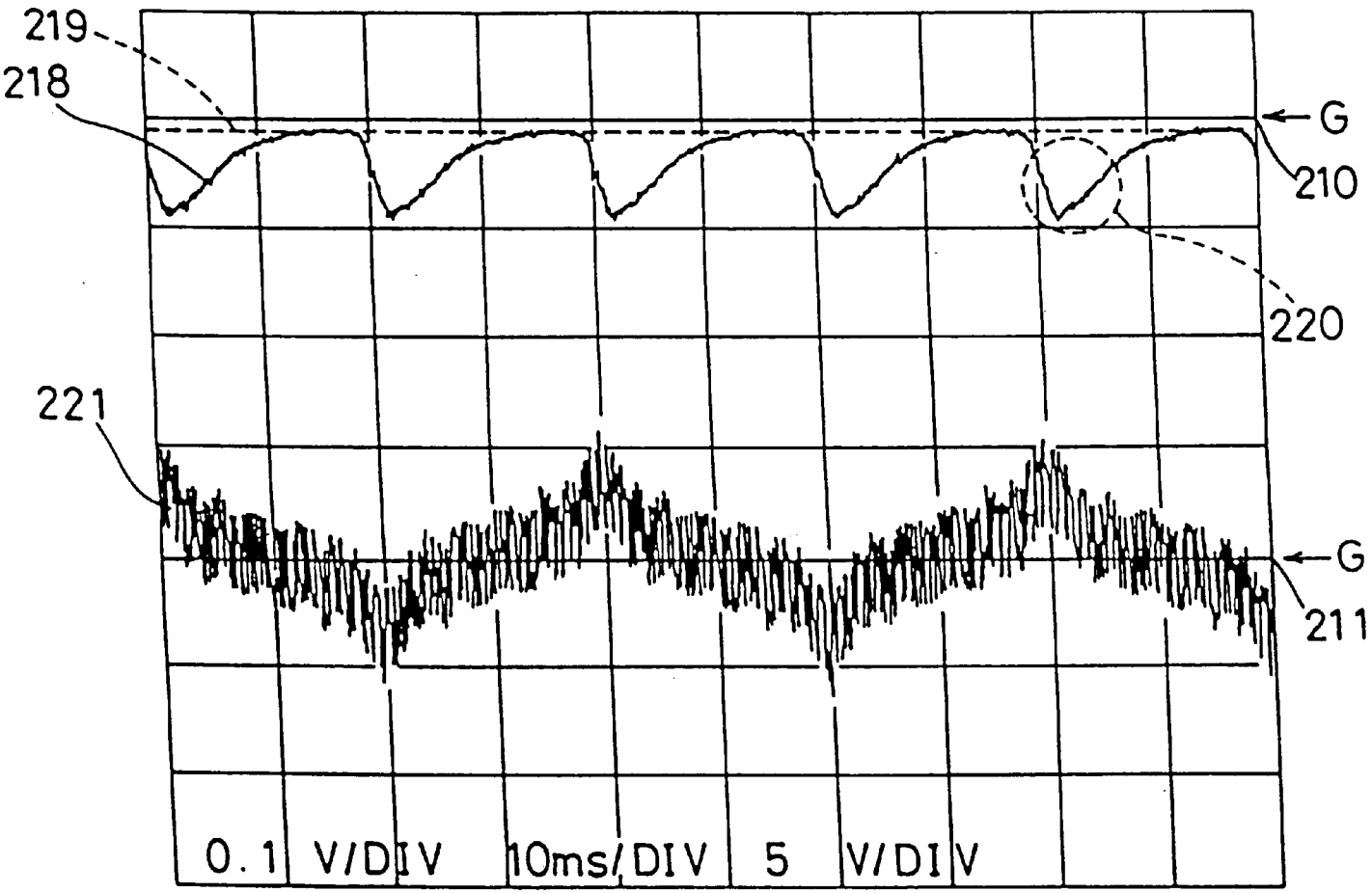
FIG. 18 PRIOR ART
FIG. 18 is a graph showing a waveform of an optic response in liquid crystal and a waveform of applied voltage in liquid crystal in a conventional method for driving a passive matrix liquid crystal display device, wherein picture image data is only data at off-state.

As shown in FIG. 1 and FIG. 2, a periodic change of low frequency which is observed in FIG. 18 is not present in the waveforms of applied voltage to liquid crystal 214, 217, regardless of the content of picture image data. Therefore, a pulsative response part shown as 220 in FIG. 18 can not be seen in the observed waveforms of an optic response in liquid crystal 212, 215 at the display of off-state, and the observed waveforms of an optic response 212, 215 are approximately equal to the ideal waveforms 213, 216. As a result, regardless of the content of picture image data, brightnesses at off-state become not only equal but also lower. Thus, in a liquid crystal panel of high-speed response, it is possible to reduce cross-talk and to improve contrast by using a driving method which selects a total number or a plurality of scanning lines simultaneously.

Furthermore, although a random reverse normal form Hadamard matrix consisting of 512 rows and 512 columns is used as the matrix of scan data in this embodiment, it is not necessarily limited to a matrix having the same number of rows and columns. The same effects can be attained by using a random reverse normal form Hadamard matrix consisting of an optional number of rows and columns which can be obtained by expanding the second-order normal form Hadamard matrix shown in Formula 10 above by Kronecker product and reversing the signs irregularly.

EXAMPLE 2

Next, a second embodiment of a method and an apparatus for driving a passive matrix liquid crystal display device of this invention will be explained by referring to formulas and drawings.

FIG. 3 shows an operation method of gradation display in a second embodiment of a method for driving a passive matrix liquid crystal display device of this invention. The same reference numerals are given to the same content of FIG. 20, and the explanation is omitted. In FIG. 3, 21 represents a matrix of picture image data consisting of 248 rows and 2 columns which is inserted with a gradation correction term 40 in the last row, and 31 represents a matrix of signal data which is comprised of operation results obtained by using the matrix of scan data 10 and the matrix of picture image data 21 and solving Formula 1 mentioned above. In addition, 51 represents a maximum value of signal data at this time.

When gradation is displayed, each element $x_{ij}$ in the matrix of picture image data 21 results in a value in the range of "−1" to "1" but not equal to "1" or "−1". Therefore, in order to make the applied effective voltage $V_{ij}$ shown in Formula 5 above be in proportion to each element $x_{ij}$ in the matrix of picture image data, it is necessary to conduct a correction in such a way that the third term in Formula 5 becomes a constant to be formed as Formula 6 mentioned above. Accordingly, gradation display can be attained when a correction term shown as Formula 15 below is inserted into Formula 5 mentioned above, and when the third term in Formula 5 becomes a total number of rows N (constant) in the matrix of picture image data 21 as shown in Formula 6 above, even if each element $x_{ij}$ in the matrix of picture image data 21 results in a value besides "1" and "−1".

$$x_{Nj}^2 = N - \sum_{t=1}^{N} x_{tj}^2 \qquad \text{(Formula 15)}$$

In FIG. 3, as an example used is a matrix of scan data 10 in 248-order which is obtained by expanding the normal form Hadamard matrix in eight-order (S=8), which is attained by expanding the normal form Hadamard matrix in two-order shown in Formula 10 above and this normal form Hadamard matrix in two-order three times by Kronecker product, and a unit matrix in 31-order by Kronecker product. Furthermore, the matrix of picture image data has 240 rows and 2 columns (N=240), each element having 1 from the first row to the N row in the first column and having 1 as dummy data from the (N+1) row to the (N+7) row. In the second column, the first row to the Nth row was provided all with "0", and the (N+1) row to the (N+7) row were provided with "1" as dummy data. In the first column as well as in the second column, the gradation correction term 40 was inserted into the (N+8) row, and as a whole, the picture image data 21 had 248 rows and 2 columns. The gradation correction term 40 becomes "0" in the first column and "$240^{1/2}$" in the second column by solving Formula 15 mentioned above with N=240. In this case, an operation order 60 shows an order of constructing the matrix of signal data 31 after being operated. Furthermore, the maximum value of signal data results in "$240^{1/2}+7$" as shown in the maximum value of signal data 51 of FIG. 3.

Next, a configuration in a second embodiment of an apparatus for driving a passive matrix liquid crystal display device of this invention and its operation will be explained.

Figure 4:
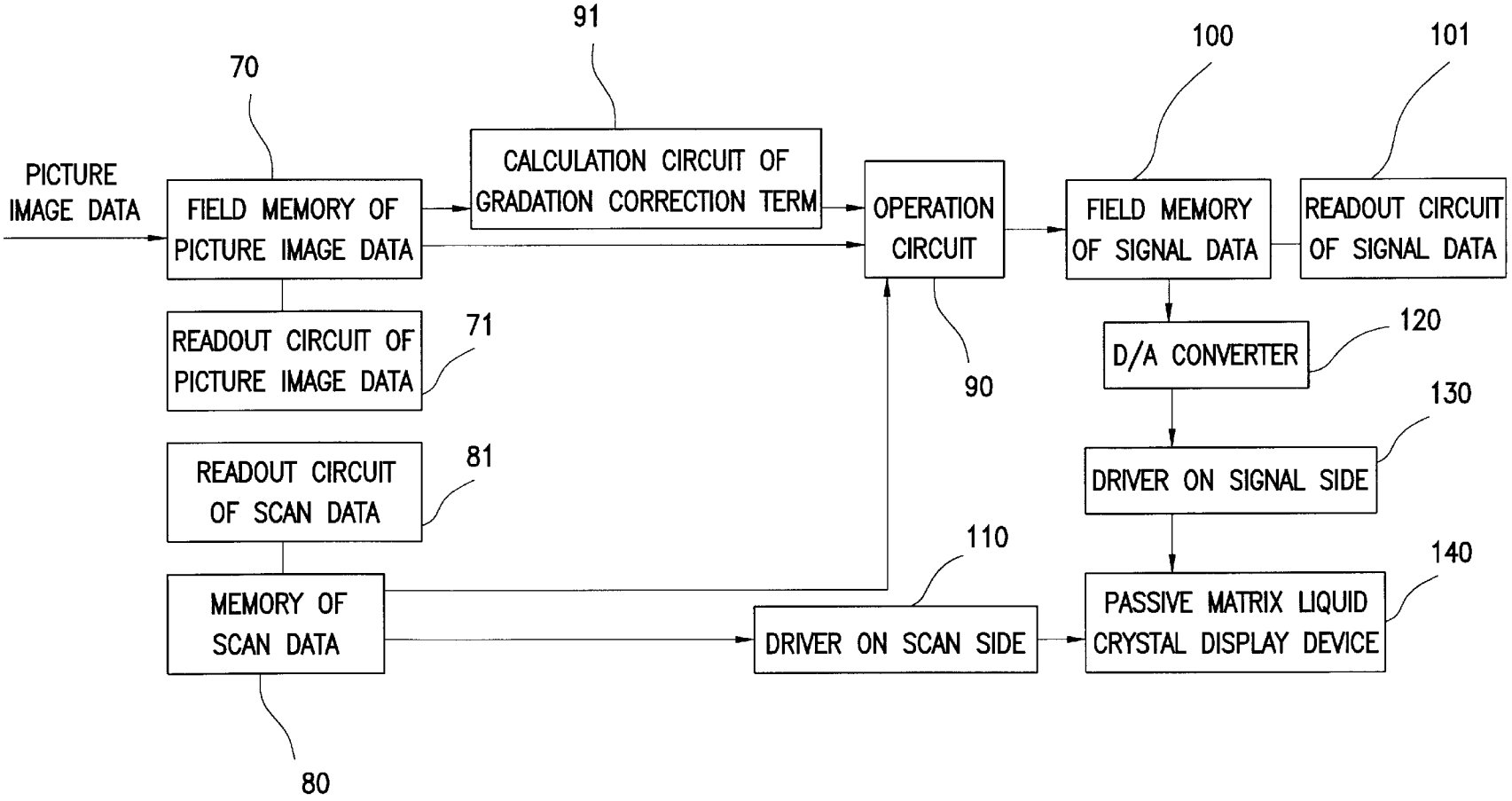
FIG. 4 is a block diagram showing a second and a third embodiment of an apparatus for driving a passive matrix liquid crystal display device of this invention.

FIG. 4 is a block diagram showing a second embodiment of an apparatus for driving a passive matrix liquid crystal display device of this invention. As shown in FIG. 4, a main apparatus for driving a passive matrix liquid crystal display device is comprised of a field memory of picture image data 70 for storing picture image data being input from outside; a readout circuit of picture image data 71 for reading out each element in a specific column of a matrix of picture image data; a calculation circuit of gradation correction term 91 for calculating a gradation correction term from the read-out picture image data; a memory of scan data memory 80 for storing scan data in advance; a readout circuit of scan data 81 for reading out specific scan data from the memory of scan data; an operation circuit of each element 90 for operating a matrix of signal data Y based on picture image data of a specific column being read out from the field memory of picture image data 70, scan data being read out from the memory of scan data 80, and the aforementioned gradation correction term; a field memory of signal data 100 for storing data after being operated; a readout circuit of signal data 101 for reading out operated signal data from the field memory of signal data 100; a driver on scan side 110; a D/A converter 120 for converting read-out signals from digital signals to analog signals; a driver on signal side 130; and a passive matrix liquid crystal display device 140.

Picture image data being input from outside is first stored in the field memory of picture image data 70. Next, each element in the first column of the matrix of picture image data 21 is read out by the readout circuit of picture image data 71. The gradation correction term 40 for the read-out picture image data is calculated by the calculation circuit of gradation correction term 91, which is then operated by the operation circuit 90 with the use of the scan data being stored in the memory of scan data 80 and Formula 1 mentioned above. At this time, each element in the matrix of scan data 10 is read out from the first row to the 248th row in order by the readout circuit of scan data 81. The same operation is conducted for the second column in the matrix of picture image data 21.

After being operated, the data is output according to the operation order 60 shown in FIG. 3 and then stored in the field memory of signal data 100. The data is read out by the readout circuit of signal data 101 in the order of transfer to the driver on signal side 130. Then, after being converted by the D/A converter 120 from digital signals to analog signals, it is transferred to the driver on signal side 130. The driver on signal side 130 applies voltage in accordance to the input analog signal data to an electrode on signal side in the passive matrix liquid crystal display device 140. On the side of scanning, the operated data is stored in the memory of scan data 80, and each element in the matrix of scan data 10 is read out from the first row to the 248th row in order by the readout circuit of scan data 81, which is then transferred to the driver on scan side 110. The driver on scan side 110 applies voltage in accordance to the input scan data to an electrode on scan side in the passive matrix liquid crystal display device 140.

According to this embodiment mentioned above, the gradation correction term 40 can be inserted into the matrix of picture image data 21 by the calculation circuit of gradation correction term 91, so that the applied effective voltage becomes in proportion to the element in the matrix of picture image data 21. Therefore, it is possible to conduct gradation control by a pulse height of the applied voltage without using a system of FRC. As a result, by using a driving method which selects a total number or a plurality of scanning lines simultaneously, a passive matrix liquid crystal display device can display gradation with higher picture quality. Furthermore, since a matrix having the same level of configuration as the first embodiment mentioned above is used as the matrix of scan data 10, the effects by the first embodiment can be obtained besides the effects mentioned above.

In this embodiment, a matrix having 240 rows and 2 columns is used as a matrix of picture image data. However, the same effects can be attained with a matrix having other optional numbers of rows and columns by using an orthogonal matrix as a matrix of scan data having a degree which matches this number of rows and conducting the above-mentioned operation.

EXAMPLE 3

Next, a third embodiment of a method for driving a passive matrix liquid crystal display device of this invention will be explained by referring to FIG. 5.

Figure 5:
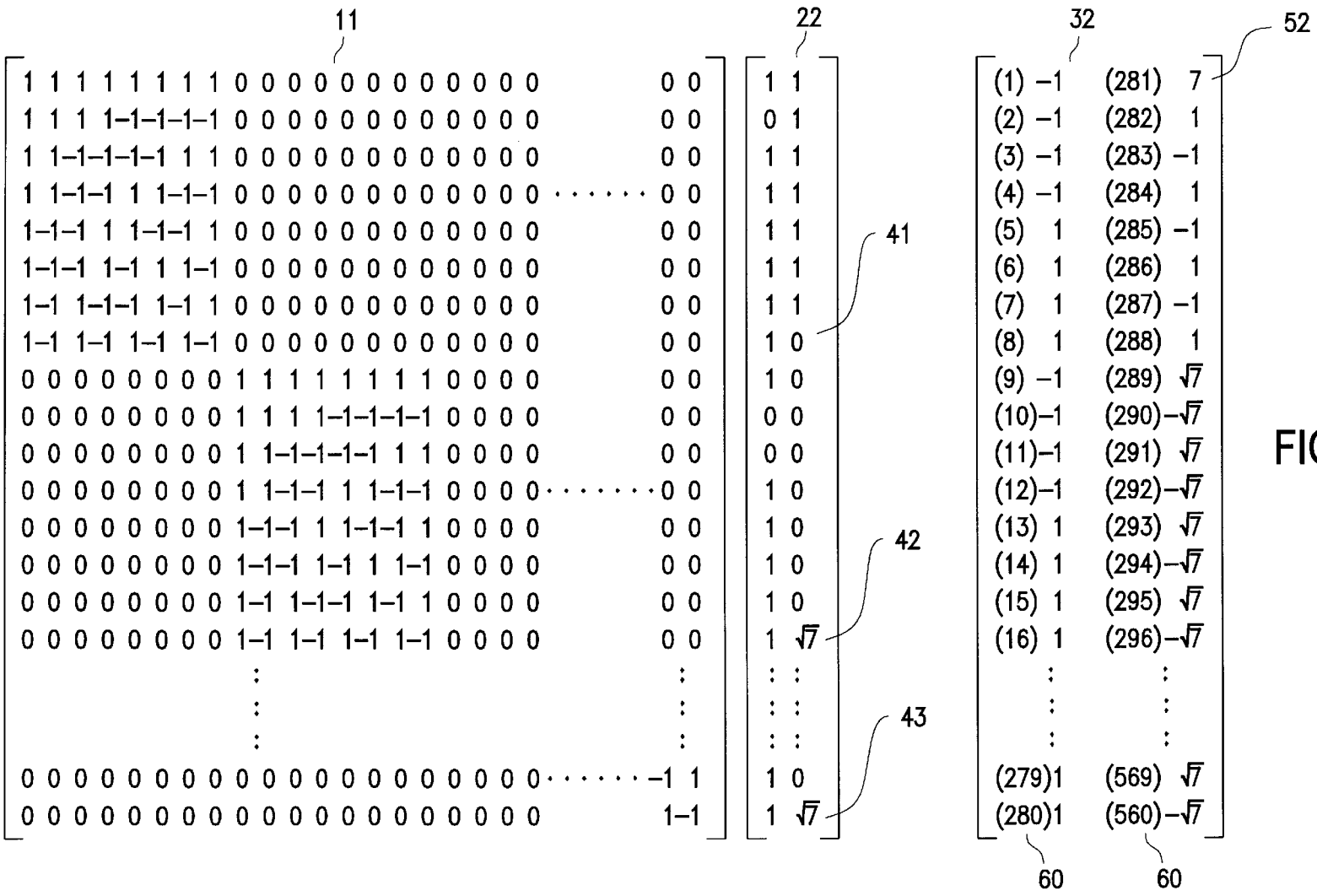
FIG. 5 is a diagram showing an operation method of gradation display in a third embodiment of a method for driving a passive matrix liquid crystal display device of this invention.

FIG. 5 shows an operation method of gradation display in a third embodiment of a method for driving a passive matrix liquid crystal display device of this invention. The same reference numerals are given to the same content with that of FIG. 3, and the explanation is omitted. In FIG. 5, 11 represents a matrix of scan data in 280-order, 22 represents a matrix of picture image data consisting of 280 rows and 2 columns, every seven rows being inserted with a gradation correction term, 32 represents a matrix of signal data which is comprised of operation results obtained by using the matrix of scan data 11 and the matrix of picture image data 22 and solving Formula 1 mentioned above, and 52 represents a maximum value of signal data at this time. Furthermore, 41 represents a gradation correction term of the matrix of picture image data 22 from the first row to the seventh row in the second column, which is the minimum value of gradation correction term. 42 represents a gradation correction term of the matrix of picture image data 22 from the ninth row to the fifteenth row in the second column, which is the maximum value of gradation correction term. 43 represents a gradation correction term from the (N+1) row to the (N+7) row in the second column.

The example used in FIG. 5 is a matrix of scan data 11 in 280-order which is obtained by expanding the normal form Hadamard matrix in eighth-order (S=8), which is attained by expanding the normal form Hadamard matrix in two-order shown in Formula 10 above and this normal form Hadamard matrix in two-order three times by Kronecker product, and a unit matrix in 35-order by Kronecker product. Furthermore, the matrix of picture image data comprises 240 rows and 2 columns (N=240), and a gradation correction term is inserted for every seven rows in the matrix of picture image data, and dummy data is inserted from the 275th row to the 279th row, and a gradation correction term from the 273rd row to the 279th row is inserted into the 280th row. As a whole, the matrix of picture image data 22 is comprised of 280 rows and 2 columns. As for each element in the matrix of picture image data 22, the first column had "0" in the second row, in the tenth row, and in the eleventh row, and the rest was all "1". Also, the second column had all "1" from the first row to the seventh row, and the rest was all "0".

When the content mentioned above is described in a mathematic formula, it can be shown as Formula 16 below, in which the third term in Formula 5 mentioned above is decomposed.

$$V_{ij}^2 = \frac{S}{N} Vb^2 \left( k^2 - 2kx_{ij} + \sum_{t=1}^{7} x_{tj}^2 + \sum_{t=8}^{14} x_{tj}^2 + \sum_{t=N-1}^{N} x_{tj}^2 \right) \quad \text{(Formula 16)}$$

In addition, based on Formula 15 mentioned above, a gradation correction value against each decomposed term can be calculated by Formula 17 mentioned below.

$$x_{Nj}^2 = N_{P1} - \sum_{t=a}^{a+6} x_{tj}^2 \quad \text{(Formula 17)}$$

In Formula 17 mentioned above, $N_{p1}$ represents a number of rows in a matrix of picture image data for gradation correction, which is $N_{p1}=7$. Moreover, only the last term can be described as Formula 18 below, and a number of rows in a matrix of picture image data for gradation correction results in $N_{P2}=2$.

$$x_{Nj}^2 = N_{P2} - \sum_{t=a}^{a+1} x_{tj}^2 \quad \text{(Formula 18)}$$

The relationship between N (=240) and $N_{P1}$, $N_{P2}$ can be described as Formula 19 below.

$$N=34\times N_{P1}+N_{P2} \quad \text{(Formula 19)}$$

Each gradation correction term is obtained by Formula 17 and Formula 18 mentioned above. The minimum value of gradation correction term 41 in FIG. 5 results in "0" by Formula 17 mentioned above, and the maximum value of gradation correction term 42 results in "$7^{1/2}$" by Formula 17 mentioned above. Furthermore, signal data reaches its maximum when each element in the rows of the matrix of scan data 11 and each element in the columns of the matrix of picture image data 22 conform to each other completely, and this value is "7" as shown as 52 in FIG. 5.

Here, a configuration of a driving apparatus which is applicable to a method of driving a passive matrix liquid crystal display device in this embodiment and its operation are the same as that of the driving apparatus in the above-mentioned second embodiment shown in FIG. 4, so the explanation is omitted.

According to this embodiment mentioned above, the maximum value of gradation correction term 42 becomes considerably smaller than the gradation correction term 40 of "$240^{1/2}$" shown in the above-mentioned second embodiment, and the maximum value of signal data 52 becomes also considerably smaller in comparison with "$240^{1/2}+7$", which is the maximum value of signal data 51 shown in the above-mentioned second embodiment. Therefore, also when gradation is displayed, an electrode on signal side can be controlled to have a low peak value of voltage. In addition, even when it is compared with "−8" which is the maximum value of signal data 50 in the conventional driving method (cf. FIG. 20), the absolute value becomes smaller, and an electrode on signal side can be controlled to have a low peak value of voltage. Thus, not only can the effects by the above-mentioned second embodiment be obtained, but also lower power consumption be attained. Moreover, since a matrix having the same level of configuration as the first embodiment mentioned above is used as the matrix of scan data 11, the effects by the first embodiment besides the above-mentioned effects can be attained.

In this embodiment, a number of rows in the matrix of picture image data was determined to be N=240, and a number of simultaneous selective rows was determined to be S=8, so it resulted in $N_{P1}=7$ and $N_{P2}=2$ by solving Formula 19 mentioned above and Formula 20 mentioned below with n=1. However, when both Formula 19 and Formula 20 are fulfilled, the same effects can be attained with each value being an optional integral number.

$$N_{P1}=nS-1 \qquad \text{(Formula 20)}$$

Furthermore, in this embodiment, a matrix having 240 rows and 2 columns is used as a matrix of picture image data. However, the same effects can be attained with a matrix having other optional numbers of rows and columns by using an orthogonal matrix as a matrix of scan data having a degree which matches this number of rows and conducting the above-mentioned operation.

EXAMPLE 4

Next, a fourth embodiment of a method for driving a passive matrix liquid crystal display device of this invention will be explained by referring to FIG. 6.

FIG. 6 shows an operation method of gradation display in a fourth embodiment of a method for driving a passive matrix liquid crystal display device of this invention. The same reference numerals are given to the same content of that in FIG. 3, and the explanation is omitted. In FIG. 6, 12 represents a matrix of scan data in eighth-order, and 23 represents a matrix of picture image data consisting of 8 rows and 2 columns having a gradation correction term inserted in the last row. Also, 33 represents a matrix of signal data which is comprised of operation results of the matrix of scan data 12 and the matrix of picture image data 23 obtained by solving Formula 1 mentioned above, and 52 represents a maximum value of signal data at this time. Furthermore, 42 represents a gradation correction term of the matrix of picture image data 23 from the first row to the seventh row in the second column.

In the above-noted third embodiment, gradation correction terms are calculated for every seven rows as shown in FIG. 5. Therefore, as a matrix of picture image data necessary for one operation, it is sufficient to have a matrix of picture image data comprising seven rows plus the eighth row for a gradation correction term. Furthermore, as for a matrix of scan data for the matrix of picture image data with eight rows, since it is all "0" except for the normal form Hadamard matrix in eighth-order, only the normal form Hadamard matrix in eighth-order can be used for operation. Therefore, an operation method shown in FIG. 6 used the normal form Hadamard matrix in eighth-order as the matrix of scan data 12, and as the matrix of picture image data 23, eight rows in the matrix of picture image data 22 shown in FIG. 5 of the above-mentioned third embodiment were used. It can be confirmed from the matrix of signal data 33 of FIG. 6 that the same operation results are obtained as that shown in FIG. 5.

Next, a configuration in a fourth embodiment of an apparatus for driving a passive matrix liquid crystal display device of this invention and its operation will be explained by referring to FIG. 7.

Figure 7:
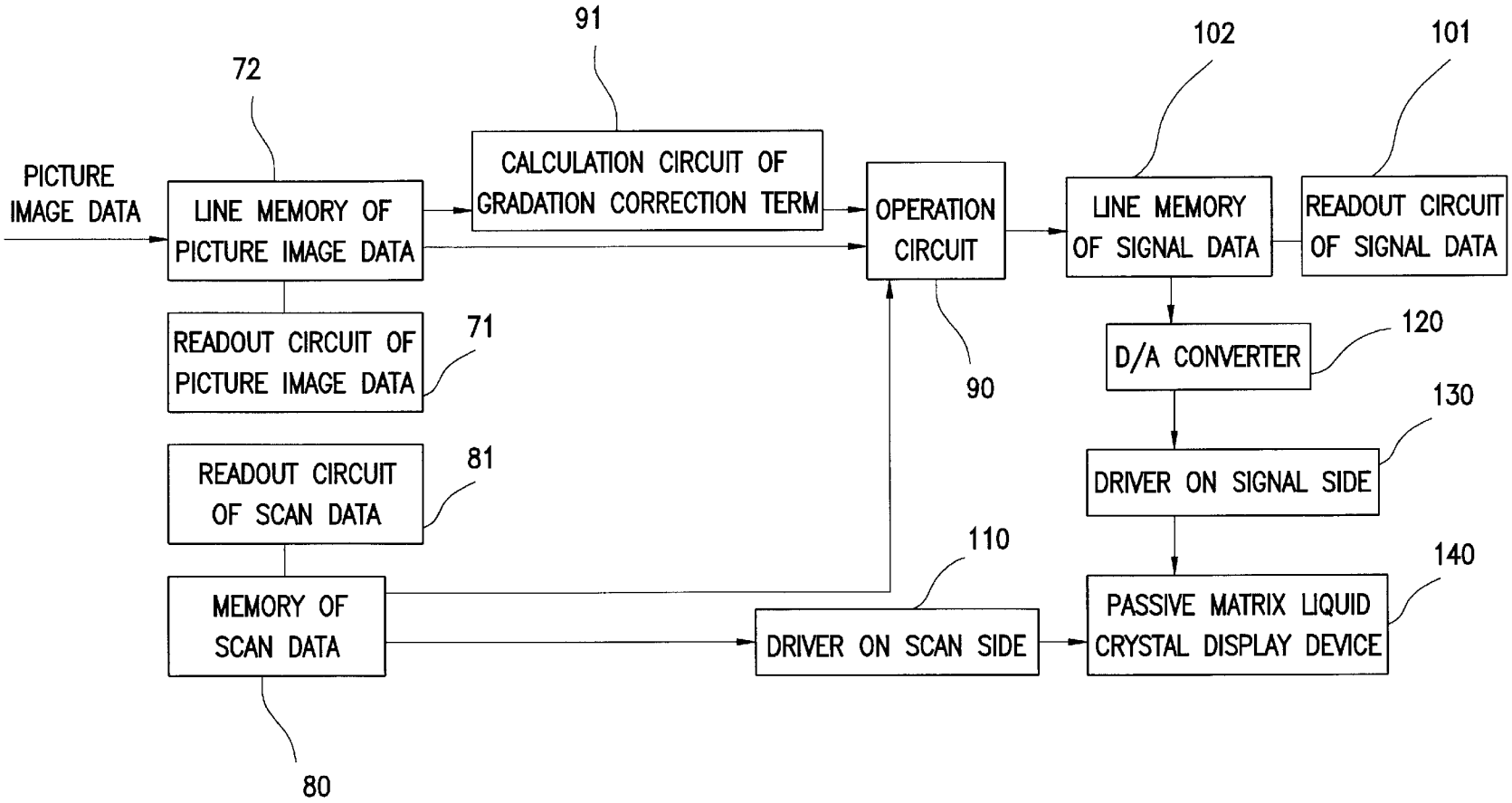
FIG. 7 is a block diagram showing a fourth embodiment of an apparatus for driving a passive matrix liquid crystal display device of this invention.

FIG. 7 is a block diagram showing a fourth embodiment of an apparatus for driving a passive matrix liquid crystal display device of this invention. In FIG. 7, the same reference numerals are given to the same parts with those in FIG. 4, and the explanation is omitted. In FIG. 7, 72 represents a line memory of picture image data, and 102 represents a line memory of signal data. As for the line memory of picture image data 72, the operation method of FIG. 6 can be applied to 240 rows in FIG. 5 to obtain a line memory for seven rows. Furthermore, as for the memory of signal data 102, the operation method of FIG. 6 can be applied to 280 rows in FIG. 5 to obtain a line memory for eight rows. In addition, with regard to the matrix of scan data 12, the operation method of FIG. 6 can be applied to the 280-order in FIG. 5 to obtain an eight-order. The operation in this embodiment differs from the second embodiment mentioned above only with respect to the field memory of picture image data 70 and the field memory of signal data 100 shown in FIG. 4 of the above-mentioned second embodiment.

According to the above-mentioned embodiment, it is posssible to reduce the capacities of the memory of scan data 80, the line memory of picture image data 72, and the line memory of signal data 102, so that not only can the effects by the above-mentioned third embodiment (lower power consumption) be attained, but also lower costs. Moreover, since a matrix having the same level of configuration with that in the above-mentioned first embodiment is used as the matrix of scan data 12, the effects by the first embodiment can be obtained besides the above-mentioned effects.

In this embodiment, a number of simultaneous selective rows was determined to be S=8, a number of rows in the matrix of picture image data for gradation correction $N_{P1}$ was determined to be 7 by solving to Formula 20 mentioned above with n=1, and a number of rows in the matrix of scan data 12 and in the matrix of picture image data 23 was determined to be 8. However, this is a value for the number of simultaneous selective rows S, so even when the number of simultaneous selective rows is different, the same effects can be attained by determining a number of rows in the matrix of scan data and in the matrix of picture image data to be a number of simultaneous selective rows, obtaining a number of rows in a matrix of picture image data for gradation correction by Formula 20, and conducting an operation.

EXAMPLE 5

Next, a fifth embodiment of a method for driving a passive matrix liquid crystal display device of this invention will be explained by referring to FIG. 8.

FIG. 8 shows an operation method of gradation display in a fifth embodiment of a method for driving a passive matrix liquid crystal display device of this invention. The same reference numerals are given to the same content of that in FIG. 6, and the explanation is omitted. In FIG. 8, 61 represents an operation order.

First, Formula 1 mentioned above is applied for operating the first row in the matrix of scan data 12 and the first row in the matrix of picture image data 23. Next, Formula 1 mentioned above is applied for operating the first row in the matrix of scan data 12 and the second row in the matrix of picture image data 23. As a result, data in the first row of the matrix of signal data 33 is constructed. Then, the second row in the matrix of signal data 33 is constructed by operating the second row in the matrix of scan data 12 and the first and the second rows in the matrix of picture image data 23. In the same manner, the third row to the eighth row in the matrix of signal data 33 are constructed. The operation order 61 of FIG. 8 shows an order of the matrix of signal data being constructed.

Next, a configuration in a fifth embodiment of an apparatus for driving a passive matrix liquid crystal display device of this invention and its operation will be explained by referring to FIG. 9.

Figure 9:
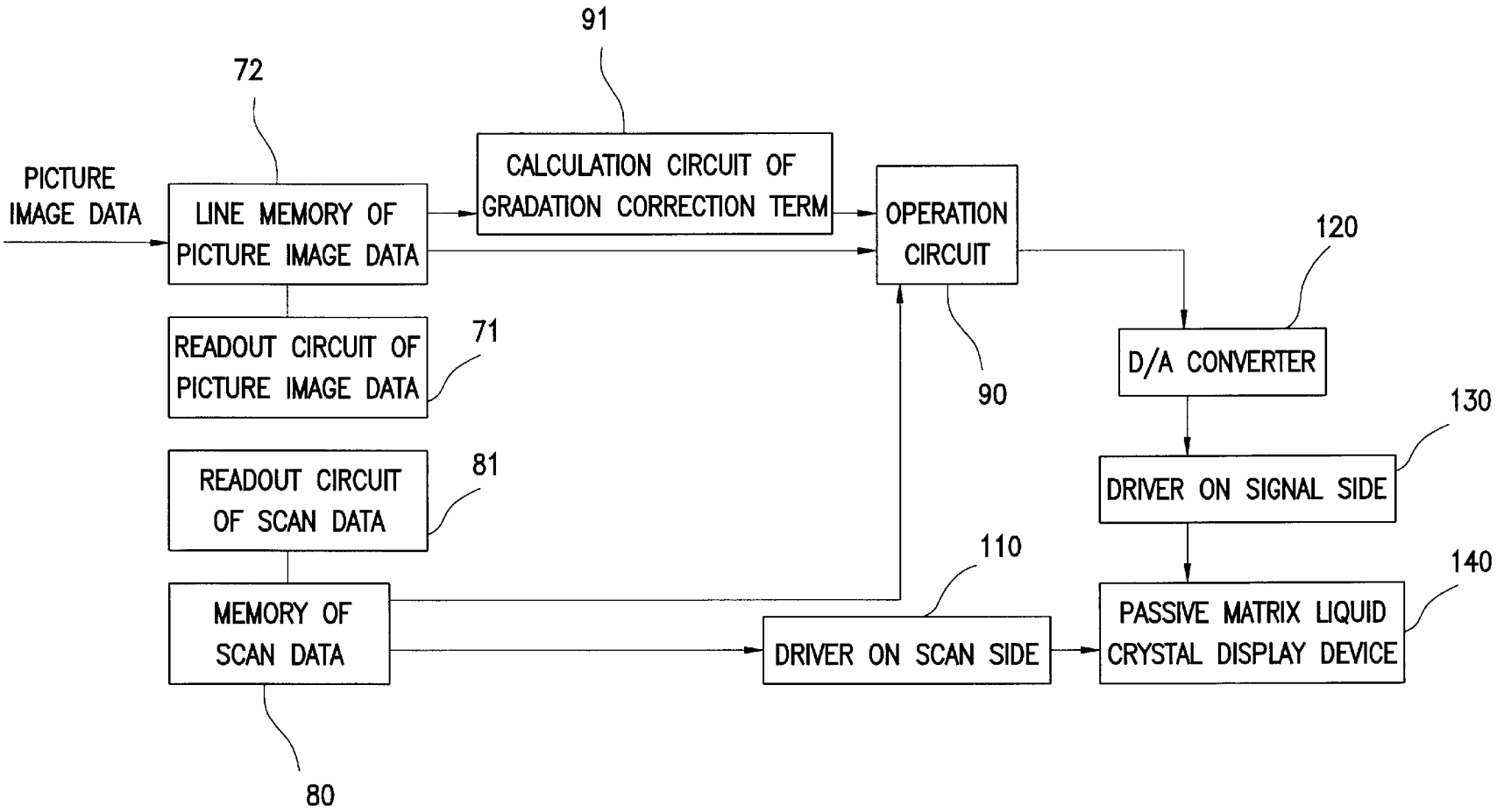
FIG. 9 is a block diagram showing a fifth embodiment of an apparatus for driving a passive matrix liquid crystal display device of this invention.

FIG. 9 is a block diagram showing a fifth embodiment of an apparatus for driving a passive matrix liquid crystal display device of this invention. In FIG. 9, the same reference numerals are given to the same parts with those in FIG. 4, and the explanation is omitted. In FIG. 9, 72 represents a line memory of picture image data, and the operation circuit 90 is directly connected to a D/A converter 120 without passing a memory.

Picture image data being input from outside is once stored in the line memory of picture image data 72 and then read out by the readout circuit of picture image data 71 according to the operation method shown in FIG. 8. One of the picture image data being read out from the line memory of picture image data 72 is input to the operation circuit 90 via the calculation circuit of gradation correction term 91, and the other are input directly into the operation circuit 90. Furthermore, scan data is readout by the readout circuit of scan data 81 according to the operation method shown in FIG. 8, so the scan data are input from the memory of scan data 80 into the operation circuit 90 for operation. Since the signal data are operated in the order of transfer to the driver on signal side 130, the signal data are transferred from the operation circuit 90 directly to the D/A converter 120 without passing a memory. The other operation is the same with that in the second embodiment shown in FIG. 4.

According to the above-mentioned configuration of the operation method and the driving apparatus, the operated signal data can be transferred directly to the D/A converter 120 without passing a memory, so that the line memory of signal data 102 of the fourth embodiment shown in FIG. 7 can be omitted. As a result, not only can the effects by the fourth embodiment (lower power consumption, lower costs) be obtained, but also a smaller size of the operation processing part. Moreover, since a matrix having the same level of configuration with that in the above-mentioned first embodiment is used as the matrix of scan data 12, the effects by the above-mentioned first embodiment can be obtained besides the effects mentioned above.

In this embodiment, a number of simultaneous selective rows was determined to be S=8, a number of rows in the matrix of picture image data for gradation correction $N_{P1}$ was determined to be 7 by solving Formula 20 mentioned above with n=1, and a number of rows in the matrix of scan data 12 and in the matrix of picture image data 23 was determined to be 8. However, this is a value for the number of simultaneous selective rows S, so even when the number of simultaneous selective rows is different, the same effects can be attained by determining a number of rows in the matrix of scan data and in the matrix of picture image data to be a number of simultaneous selective rows, obtaining a number of rows in a matrix of picture image data for gradation correction by Formula 20, and conducting an operation.

EXAMPLE 6

Next, a sixth embodiment of an apparatus for driving a passive matrix liquid crystal display device of this invention will be explained by referring to FIG. 10.

Figure 10:
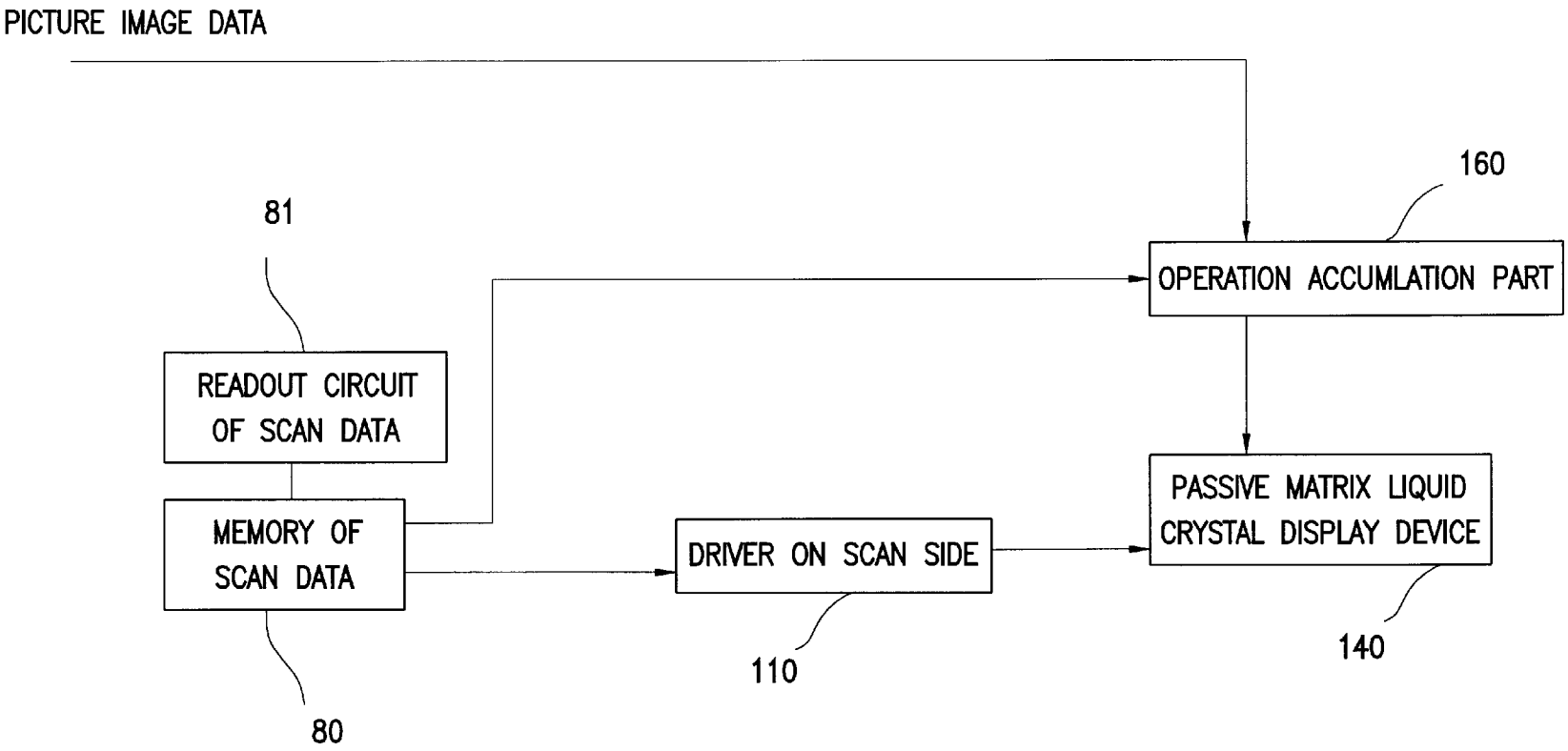
FIG. 10 is a block diagram showing a sixth embodiment of an apparatus for driving a passive matrix liquid crystal display device of this invention.

FIG. 10 is a block diagram showing a sixth embodiment of an apparatus for driving a passive matrix liquid crystal display device of this invention. In FIG. 10, the same reference numerals are given to the same parts with those in FIG. 9, and the explanation is omitted. In FIG. 10, 160 represents an operation accumulation part. Furthermore, an operation method and its operation in the driving apparatus of this embodiment are basically the same as in the fifth embodiment mentioned above. In this driving apparatus, the line memory of picture image data 72, the readout circuit of picture image data 71, the calculation circuit of gradation correction term 91, the operation circuit 90, the D/A converter 120, and the driver on signal side 130 of the fifth embodiment shown in FIG. 9 were integrated to form the operation accumulation part 160 shown in FIG. 10.

According to the above-mentioned configuration of the driving apparatus, the effects by the fifth embodiment (lower power consumption, lower costs, a smaller operation processing part) can be improved even more. Moreover, since a matrix having the same level of configuration with that in the above-mentioned first embodiment is used as the matrix of scan data 12, the effects by the above-mentioned first embodiment can be obtained besides the effects mentioned above.

In this embodiment, a number of simultaneous selective rows was determined to be S=8, a number of rows in the matrix of picture image data for gradation correction $N_{P1}$ was determined to be 7 by solving Formula 20 mentioned above with n=1, and a number of rows in the matrix of scan data and in the matrix of picture image data was determined to be 8. However, this is a value for the number of simultaneous selective rows S, so even when the number of simultaneous selective rows is different, the same effects can be attained by determining a number of rows in the matrix of scan data and in the matrix of picture image data to be a number of simultaneous selective rows, obtaining a number of rows in a matrix of picture image data for gradation correction by Formula 20, and conducting an operation.

EXAMPLE 7

Next, a seventh embodiment of a method for driving a passive matrix liquid crystal display device of this invention will be explained by referring to FIG. 11.

Figure 11:
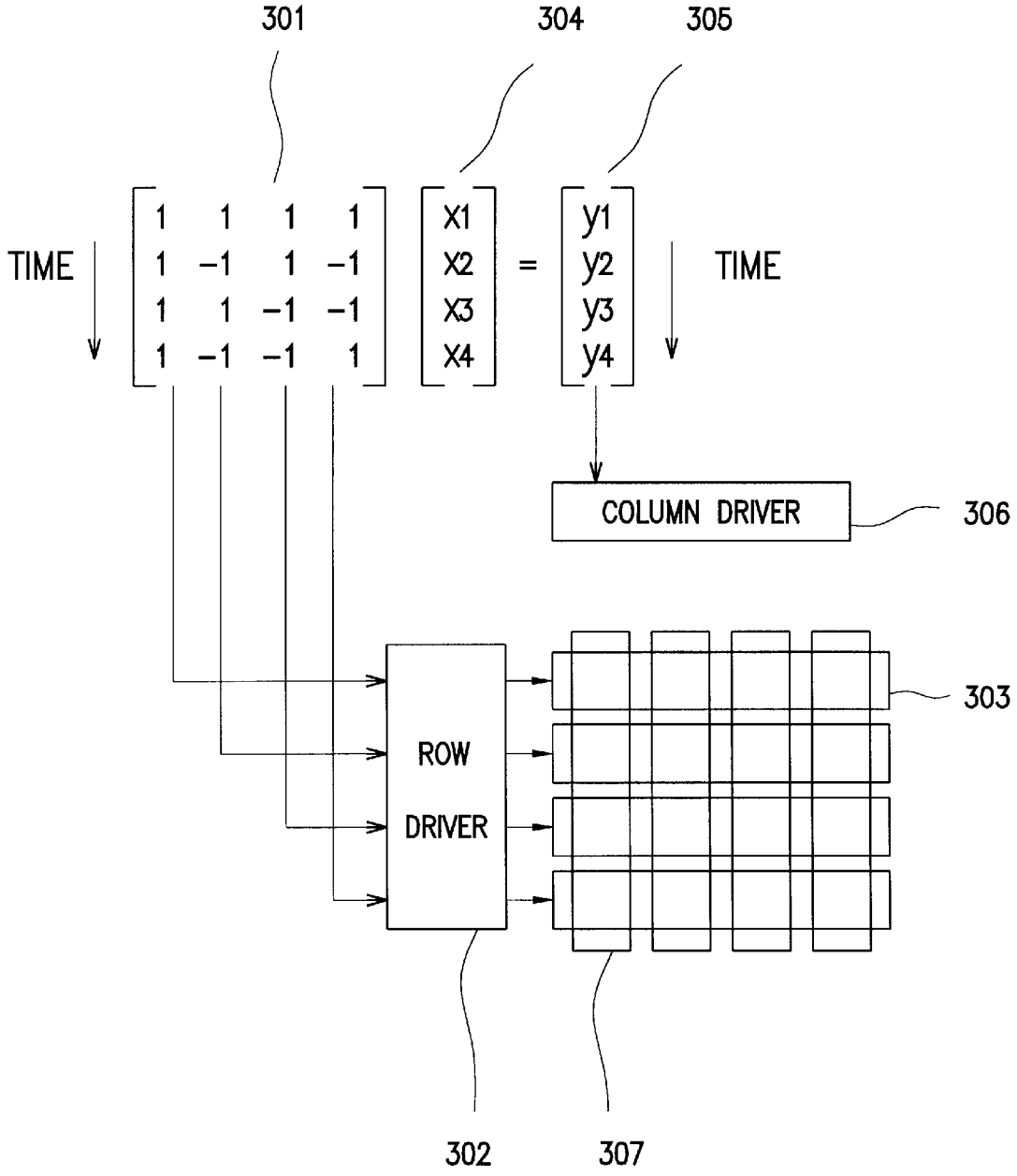
FIG. 11 is a diagram showing the relationship between a matrix product operation and drive of a passive matrix liquid crystal display device in a seventh embodiment of a method for driving a passive matrix liquid crystal display device of this invention.

FIG. 11 is a drawing showing the relationship between a matrix product operation and drive of a passive matrix liquid crystal display device in this embodiment. Data in a matrix of scan data 301 is sent to a row electrode 303 by way of a row driver 302, and data in a matrix of signal data 305 which is a matrix product of the matrix of scan data 301 and the matrix of picture image data 304 is sent further to a column electrode 307 by way of a column driver 306.

FIG. 12 shows the relationship between a sub matrix 311 and a matrix of scan data 312. Here, the sub matrix 311 is an orthogonal matrix comprising elements of "1" or "−1". The sub matrix 311 in n-order is expanded to the matrix of scan data 312 in m×n-order by Kronecker product with a unit matrix 310 in m-order. The matrix of scan data 312 is also an orthogonal matrix. FIG. 12 shows an example of m=4 and n=4.

One example will be explained by using FIGS. 13 to 16. The sub matrix used is an orthogonal matrix shown as Formula 21 below (a number of simultaneous selective rows S=16).

$$\begin{bmatrix}
1 & -1 & 1 & 1 & -1 & 1 & -1 & -1 & 1 & -1 & 1 & 1 & -1 & 1 & -1 & -1 \\
1 & -1 & 1 & 1 & -1 & 1 & -1 & -1 & -1 & 1 & -1 & -1 & 1 & -1 & 1 & 1 \\
1 & -1 & 1 & 1 & 1 & -1 & 1 & 1 & -1 & 1 & -1 & -1 & -1 & 1 & -1 & -1 \\
1 & -1 & 1 & 1 & 1 & -1 & 1 & 1 & 1 & -1 & 1 & 1 & 1 & -1 & 1 & 1 \\
1 & -1 & -1 & -1 & 1 & -1 & -1 & -1 & 1 & -1 & -1 & -1 & 1 & -1 & -1 & -1 \\
1 & -1 & -1 & -1 & 1 & -1 & -1 & -1 & -1 & 1 & 1 & 1 & -1 & 1 & 1 & 1 \\
1 & -1 & -1 & -1 & -1 & 1 & 1 & 1 & -1 & 1 & 1 & 1 & 1 & -1 & -1 & -1 \\
1 & -1 & -1 & -1 & -1 & 1 & 1 & 1 & 1 & -1 & -1 & -1 & -1 & 1 & 1 & 1 \\
1 & 1 & -1 & 1 & -1 & -1 & 1 & -1 & 1 & 1 & -1 & 1 & -1 & -1 & 1 & -1 \\
1 & 1 & -1 & 1 & -1 & -1 & 1 & -1 & -1 & -1 & 1 & -1 & 1 & 1 & -1 & 1 \\
1 & 1 & -1 & 1 & 1 & 1 & -1 & 1 & -1 & -1 & 1 & -1 & -1 & -1 & 1 & -1 \\
1 & 1 & -1 & 1 & 1 & 1 & -1 & 1 & 1 & 1 & -1 & 1 & 1 & 1 & -1 & 1 \\
1 & 1 & 1 & -1 & 1 & 1 & 1 & -1 & 1 & 1 & 1 & -1 & 1 & 1 & 1 & -1 \\
1 & 1 & 1 & -1 & 1 & 1 & 1 & -1 & -1 & -1 & -1 & 1 & -1 & -1 & -1 & 1 \\
1 & 1 & 1 & -1 & -1 & -1 & -1 & 1 & -1 & -1 & -1 & 1 & 1 & 1 & 1 & -1 \\
1 & 1 & 1 & -1 & -1 & -1 & -1 & 1 & 1 & 1 & 1 & -1 & -1 & -1 & -1 & 1
\end{bmatrix} \quad \text{(Formula 21)}$$

Figure 13:
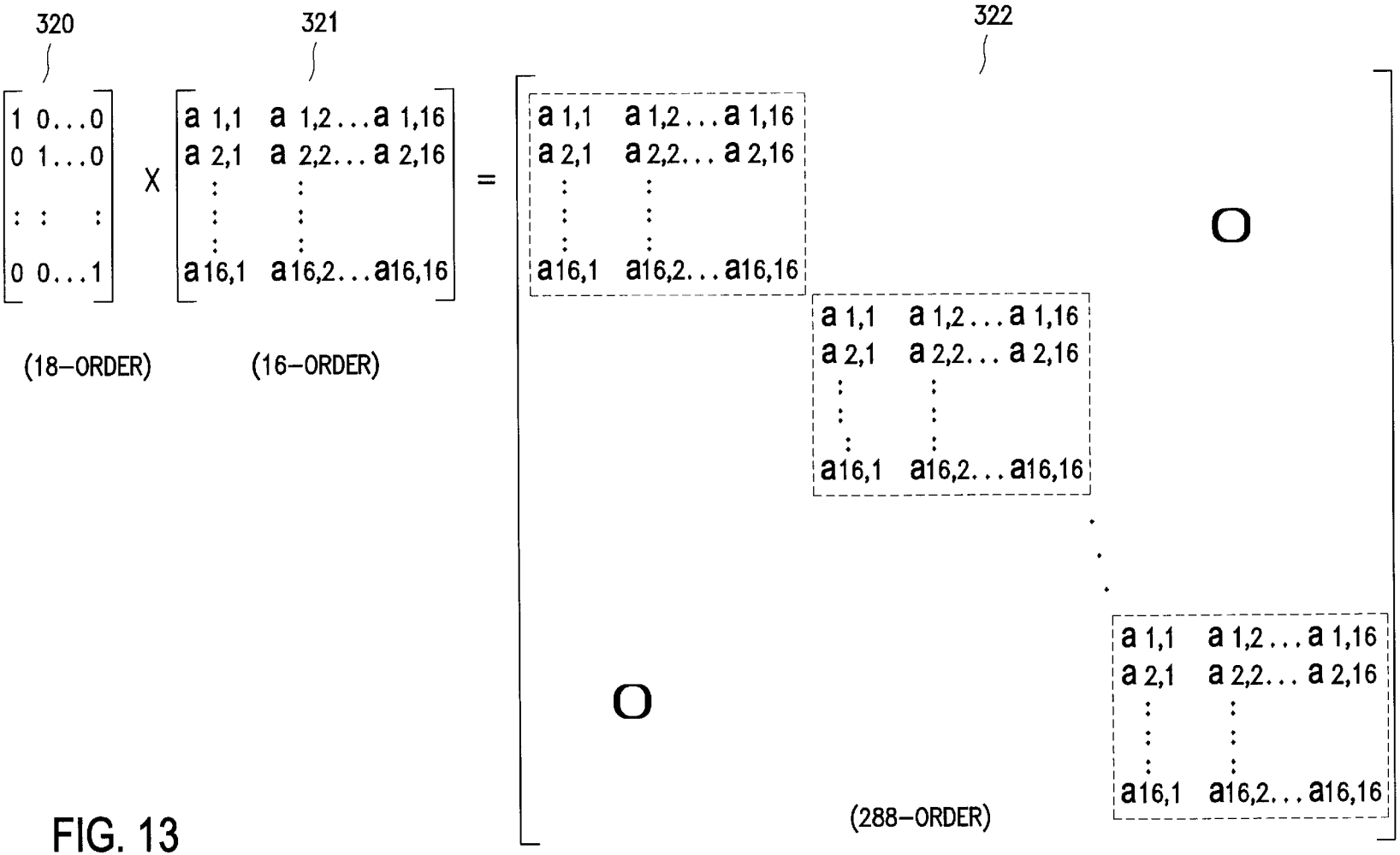
FIG. 13 is a diagram showing the expansion of Kronecker product by a unit matrix of a sub matrix in a seventh embodiment of a method for driving a passive matrix liquid crystal display device of this invention.
Figure 15:
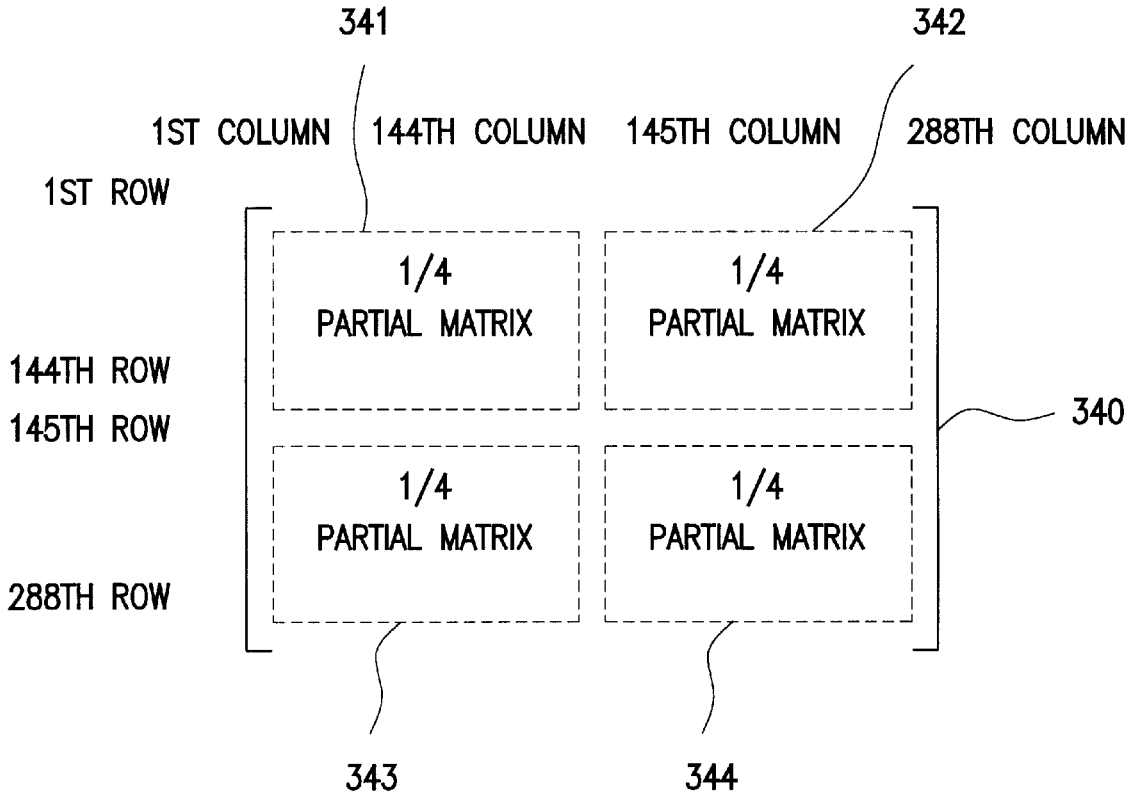
FIG. 15 is a diagram showing a method of quadrisection in a matrix of scan data matrix in a seventh embodiment of a method for driving a passive matrix liquid crystal display device of this invention.
Figure 16:
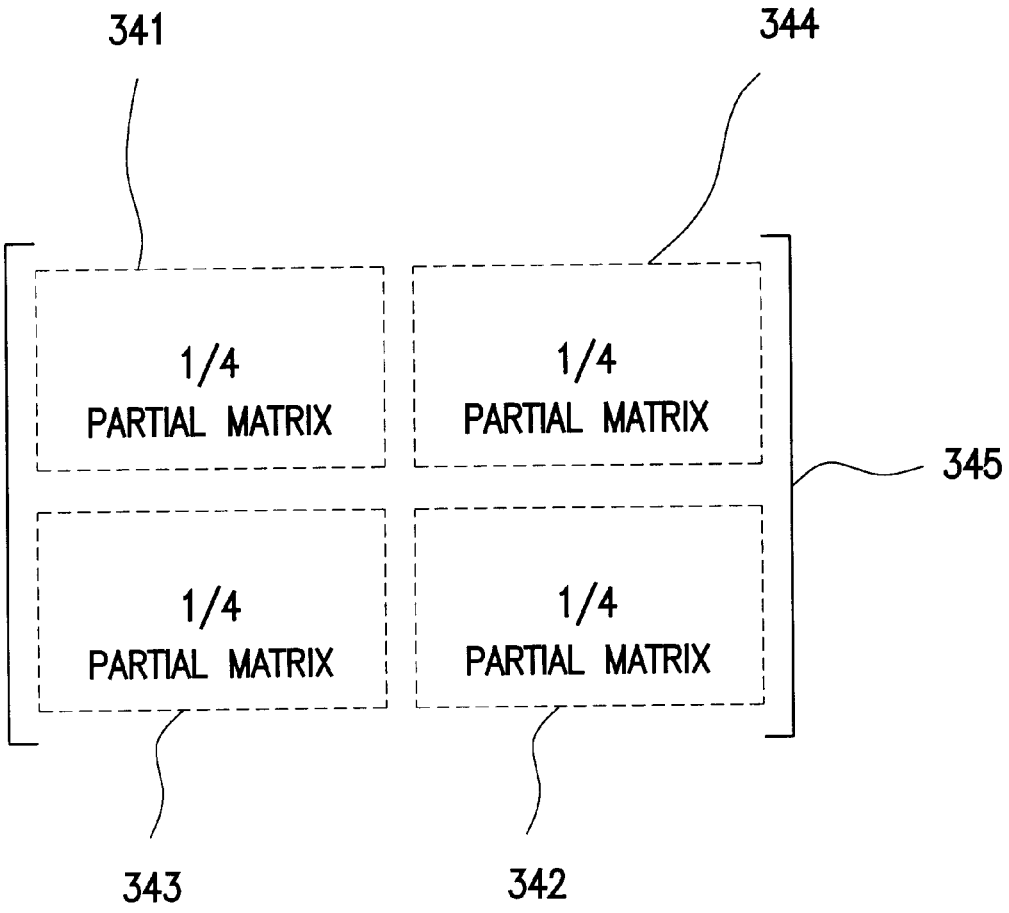
FIG. 16 is a diagram showing a method of interchanging a partial matrix of a quadrisection in a matrix of scan data in a seventh embodiment of a method for driving a passive matrix liquid crystal display device of this invention.
Figure 17:
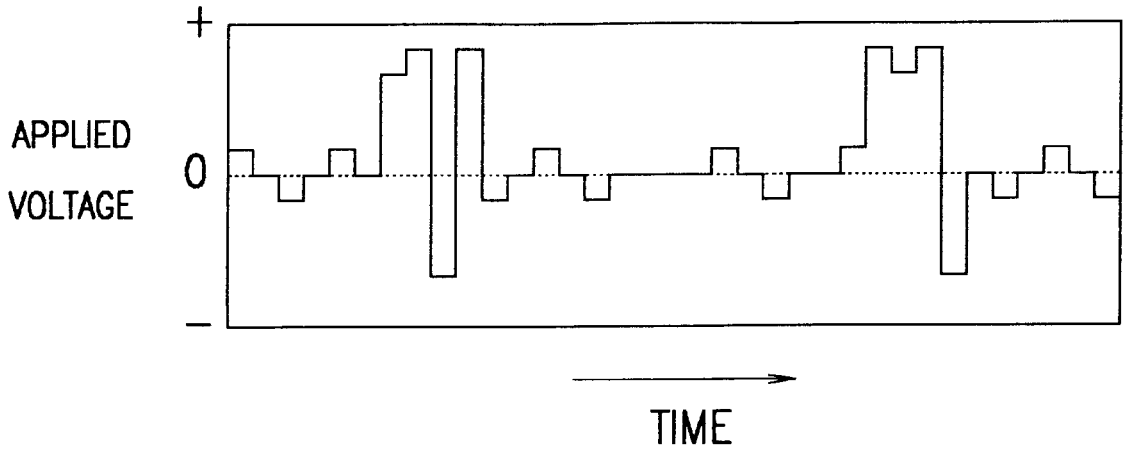
FIG. 17 is a diagram showing a waveform of signal data in a seventh embodiment of a method for driving a passive matrix liquid crystal display device of this invention.
Figure 22:
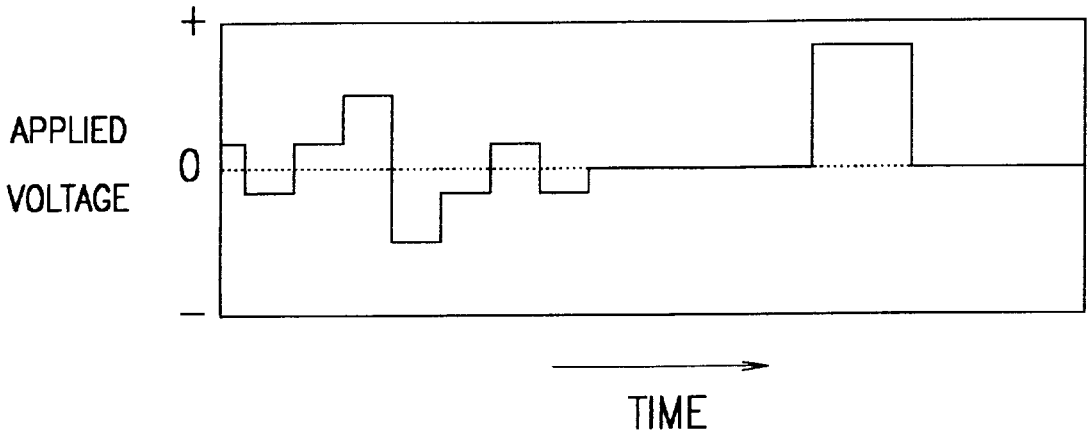
FIG. 22 PRIOR ART
FIG. 22 is a diagram showing a waveform of signal data in a conventional method for driving a passive matrix liquid crystal display device.

First, as shown in FIG. 13, a sub matrix 321 in 16-order is expanded by Kronecker product with a unit matrix 320 in 18-order to produce a matrix of scan data 322 in 288-order. Next, in order to shorten an interval between selective periods for preventing a frame response, the matrix of scan data 322 is rearranged by means of the rearrangement operation shown as Formula 13 above to a rearranged form shown in FIG. 14. In other words, a non-0 element part in the matrix of scan data 322 is expanded stepwise. At this time, it is n=16 and m=18. Next, the matrix of FIG. 14 is divided into two equal parts in the row direction and in the column direction respectively as shown in FIG. 15, which results in four pieces of ¼ partial matrixes. Namely, the matrix is divided into a partial matrix 341 comprising the elements from the first row to the 144th row and from the first column to the 144th column, a partial matrix 342 comprising the elements from the first row to the 144th row and from the 145th column to the 288th column, a partial matrix 343 comprising the elements from the 145th row to the 288th row and from the first column to the 144th column, and a partial matrix 344 comprising the elements from the 145th row to the 288th row and from the 145th column to the 288th column. Subsequently, the partial matrix 342 and the partial matrix 344 shown in FIG. 15 are interchanged to form the matrix shown in FIG. 16. With the use of the matrix of scan data 345 (FIG. 16) formed in the above-mentioned manner, a matrix product operation is conducted with a matrix of picture image data. A matrix of signal data obtained here has a waveform of signal data shown in FIG. 17 in an optional column. When this waveform is compared with a waveform of signal data in the conventional technique shown in FIG. 22, it is clear that frequency in the direction of time axis becomes higher, and that omnipresence of applied voltage is dispersed.

According to the configuration of this embodiment mentioned above, by interchanging the partial matrixes in the matrix of scan data, omnipresence of applied voltage on the matrix of signal data side is moved to higher frequency in the direction of time axis. Therefore, irregularity of a pulse height of applied voltage can be controlled, which results in controlling irregularity of an optical response in liquid crystal in correspondence to this voltage, so that course-marked contrast patterns can be reduced in the displayed picture image. In this way, the quality of display can be improved.

Also, in this embodiment, when the matrix of scan data 345 was produced, the matrix in FIG. 14 was divided into two equal parts in the row direction and in the column direction respectively to form four pieces of ¼ partial matrixes, but it is not necessarily limited to this configuration. The same effects can be attained by attaining higher frequency of signal data with the use of a matrix of scan data which is divided into k equal parts in the row direction (a column degree divided by k, k is an integral number of two and more) and into j equal parts in the column direction (a row degree divided by j, j is an integral number of two and more), wherein the partial matrixes are rearranged in an optional order.

In addition, the sub matrix 321 in 16-order and the matrix of scan data 322 in 288-order were used as examples for explaining this embodiment, but the same effects can be attained by using a sub matrix and a matrix of scan data having a different order than these orders.

EXAMPLE 8

Next, an eighth embodiment of this invention will be explained.

In this embodiment, the sub matrix in the above-mentioned seventh embodiment is processed at a stage before expanding by Kronecker product. The processing method will be explained in the following. When the sub matrix shown as Formula 21 above is seen in the longitudinal direction, by paying the attention on a frequency of switching between "1" and "−1", it results in Table 1 below.

TABLE 1

| Row number | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| Frequency of switching | 0 | 1 | 2 | 3 | 4 | 5 | 6 | 7 | 8 | 9 | 10 | 11 | 12 | 13 | * | * |

* The 15. and 16. column are not taken into consideration because they correspond to a part with correction terms.

The higher the frequency of switching is, the greater the loss of applied voltage will be, and the display becomes darker. In other words, it is considered such that irregular contrast gradation appears in a display row which corresponds to a column having a large difference in the frequency of switching. Then, the sub matrix shown as Formula 21 above is rearranged at a unit of column in order to make this difference in the frequency of switching to become approximately equal. When a rearrangement takes place with a column as one unit, orthogonality of the matrix is retained.

In this embodiment, it was rearranged as in Formula 22 below.

$$\begin{bmatrix} -1 & 1 & -1 & -1 & 1 & -1 & -1 & 1 & 1 & 1 & 1 & -1 & -1 & 1 & 1 & -1 \\ -1 & -1 & 1 & -1 & 1 & 1 & -1 & -1 & 1 & -1 & 1 & 1 & -1 & -1 & 1 & 1 \\ -1 & -1 & -1 & 1 & 1 & 1 & 1 & 1 & 1 & -1 & -1 & -1 & 1 & -1 & 1 & -1 \\ -1 & 1 & 1 & 1 & 1 & -1 & 1 & -1 & 1 & 1 & -1 & 1 & 1 & 1 & 1 & 1 \\ -1 & 1 & -1 & -1 & -1 & -1 & -1 & -1 & -1 & -1 & -1 & 1 & 1 & -1 & 1 & -1 \\ -1 & -1 & 1 & -1 & -1 & 1 & -1 & 1 & -1 & 1 & -1 & -1 & 1 & 1 & 1 & 1 \\ -1 & -1 & -1 & 1 & -1 & 1 & 1 & -1 & -1 & 1 & 1 & 1 & -1 & 1 & 1 & -1 \\ -1 & 1 & 1 & 1 & -1 & -1 & 1 & 1 & -1 & -1 & 1 & -1 & -1 & -1 & 1 & 1 \\ 1 & 1 & 1 & -1 & -1 & 1 & 1 & -1 & 1 & -1 & -1 & -1 & -1 & 1 & 1 & -1 \\ 1 & -1 & -1 & -1 & -1 & -1 & 1 & 1 & 1 & 1 & -1 & 1 & -1 & -1 & 1 & 1 \\ 1 & -1 & 1 & 1 & -1 & -1 & -1 & -1 & 1 & 1 & 1 & -1 & 1 & -1 & 1 & -1 \\ 1 & 1 & -1 & 1 & -1 & 1 & -1 & 1 & 1 & -1 & 1 & 1 & 1 & 1 & 1 & 1 \\ 1 & 1 & 1 & -1 & 1 & 1 & 1 & 1 & -1 & 1 & 1 & 1 & 1 & -1 & 1 & -1 \\ 1 & -1 & -1 & -1 & 1 & -1 & 1 & -1 & -1 & -1 & 1 & -1 & 1 & 1 & 1 & 1 \\ 1 & -1 & 1 & 1 & 1 & -1 & -1 & 1 & -1 & -1 & -1 & 1 & -1 & 1 & 1 & -1 \\ 1 & 1 & -1 & 1 & 1 & 1 & -1 & -1 & -1 & 1 & -1 & -1 & -1 & -1 & 1 & 1 \end{bmatrix} \quad \text{(Formula22)}$$

A frequency of switching which corresponds to this formula results in Table 2 shown below.

TABLE 2

| Row number | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| Frequency of switching | 1 | 8 | 14 | 7 | 2 | 9 | 6 | 13 | 3 | 10 | 5 | 12 | 4 | 11 | * | * |

(*) The 15. and 16. column are not taken into consideration because they correspond to a part with correction terms.

When a matrix of scan data is used which is produced by using the sub matrix (Formula 22) obtained in the above-mentioned manner and extending and expanding it according to the procedure of the seventh embodiment mentioned above, it is possible to reduce course-marked contrast patterns in the displayed picture image even more. As a result, the quality of display can be further improved.

In Tables 1 and 2 mentioned above, the reason why the column numbers 15 and 16 are described as "correspond to a part with correction terms" is as follows. Namely, in this embodiment, among a total number of 16 columns in the sub matrix, parts corresponding to the matrix of picture image data which are operated with the fifteenth column and the sixteenth column are respectively inserted with dummy data for voltage correction at the time of drive. Since this part with dummy data is actually not displayed, the difference in the frequency of switching between "1" and "−1" can be ignored for these two columns.

The invention may be embodied in other forms without departing from the spirit or essential characteristics thereof. The embodiments disclosed in this application are to be considered in all respects as illustrative and not as restrictive. The scope of the invention is indicated by the appended claims rather than by the foregoing description, and all changes which come within the meaning and range of equivalency of the claims are intended to be embraced therein.

What is claimed is:

1. An apparatus for driving a liquid crystal display device comprising: picture image data storing means for storing picture image data which is input from outside; picture image data readout means for reading out each element in a specific column of a matrix of picture image data from said picture image data storing means; gradation correction term calculation means for calculating a gradation correction term from the read-out picture image data; scan data storing means for storing scan data in advance; scan data readout means for reading out specific scan data from the scan data storing means; operation means for operating a matrix of signal data based on the picture image data in a specific column being read out from said picture image data storing means, scan data being read out from said scan data storing means, and said gradation correction term; and signal data storing means for storing signal data after being operated, wherein the gradation correction term calculation means inserts the gradation correction term for every predetermined row in the matrix of picture image data.

2. A method for driving a passive matrix liquid crystal display device, comprising the steps of:

generating a matrix of signal data by operating a matrix of picture image data being input from outside with a matrix of scan data;

applying voltage to scanning electrodes in correspondence to the matrix of scan data; and applying voltage to signal electrodes in correspondence to the matrix of signal data;

wherein the matrix of scan data used is an orthogonal matrix, and gradation is displayed by correcting gradation with the matrix of picture image data within one frame gradation is corrected for a plurality of times within one frame, and a number of picture image data for calculation of gradation correction value is less than a total number of rows in the matrix of picture image data.

3. A method for driving a passive matrix liquid crystal display device, comprising the steps of:

generating a matrix of signal data by operating a matrix of picture image data being input from outside with a matrix of scan data;

applying voltage to scanning electrodes in correspondence to the matrix of scan data; and applying voltage to signal electrodes in correspondence to the matrix of signal data;

wherein the matrix of scan data used is an orthogonal matrix, and gradation is displayed by correcting gradation with the matrix of picture image data within one frame, the number of picture image data for calculation of gradation correction value is one less than the number of elements, other than 0, in an optional row of the matrix of scan data, and a frequency of conducting gradation correction within one frame is a value being divided with a number of elements, other than 0, in an optional row of the matrix of scan data.

4. A method for driving a passive matrix liquid crystal display device, comprising the steps of:

generating a matrix of signal data by operating a matrix of picture image data being input from outside with a matrix of scan data;

applying voltage to scanning electrodes in correspondence to the matrix of scan data; and applying voltage to signal electrodes in correspondence to the matrix of signal data;

wherein the matrix of scan data used is an orthogonal matrix, and gradation is displayed by correcting gradation with the matrix of picture image data within one frame, the number of picture image data for calculation of gradation correction value is one less than the number of elements, other than 0, in an optional row in the matrix of scan data multiplied by an integral number, and a frequency of conducting gradation correction within one frame is a value, which is a total number of rows being divided with a number of elements, other than 0, in an optional row of the matrix of scan data multiplied by an integral number.

5. A method for driving a passive matrix liquid crystal display device, comprising the steps of:

generating a matrix of signal data by operating a matrix of picture image data being input from outside with a matrix of scan data;

applying voltage to scanning electrodes in correspondence to the matrix of scan data; and applying voltage to signal electrodes in correspondence to the matrix of signal data;

wherein the matrix of scan data used is an orthogonal matrix, and gradation is displayed by correcting gradation with the matrix of picture image data within one frame, the matrix of picture image data being input from outside is first stored in a storing element of the input part and then operated with the matrix of scan data, and the operation is conducted in the order of transfer to a driver on signal side.

6. A method for driving a passive matrix liquid crystal display device, comprising the steps of:

generating a matrix of signal data by operating a matrix of picture image data being input from outside with a matrix of scan data;

applying voltage to scanning electrodes in correspondence to the matrix of scan data; and applying voltage to signal electrodes in correspondence to the matrix of signal data;

wherein the matrix of scan data used is an orthogonal matrix, and gradation is displayed by correcting gradation with the matrix of picture image data within one frame, the matrix of scan data used is an orthogonal matrix, which is a matrix being expanded with a unit matrix by Kronecker product, wherein the matrix comprises either "1" or "−1" as each element, does not include a row or a column consisting only of one value element selected from "1" and "−1", and does not include a row or a column having "1" and "−1" arranged in turn at an equal rate.

7. A method for driving a passive matrix liquid crystal display device, comprising the steps of:

generating a matrix of signal data by operating a matrix of picture image data being input from outside with a matrix of scan data;

applying voltage to scanning electrodes in correspondence to the matrix of scan data; and applying voltage to signal electrodes in correspondence to the matrix of signal data;

wherein the matrix of scan data used is an orthogonal matrix, and gradation is displayed by correcting gradation with the matrix of picture image data within one frame, the matrix of scan data used is an orthogonal matrix, which is a matrix being expanded with a unit matrix by Kronecker product, wherein the matrix is produced by reversing signs irregularly in a normal form Hadamard matrix in n-order (n is a natural number) each element comprising either "1" or "−1".

8. A method for driving a passive matrix liquid crystal display device, comprising the steps of:

generating a matrix of signal data by operating a matrix of picture image data being input from outside with a matrix of scan data;

applying voltage to row electrodes in correspondence to the matrix of scan data; and applying voltage to column electrodes in correspondence to the matrix of signal data;

wherein the matrix of scan data is an optional orthogonal matrix comprising two value elements of "1" and "−1" being expanded with a unit matrix by Kronecker product, and after a non-0 element part is expanded stepwise in order to shorten an interval between each selective period, integral numbers j and k having values of two and more are used for dividing the matrix into k equal parts in the row direction and into j equal parts in the column direction, thereby dividing it into k×j pieces of 1/(k×j) partial matrixes, and j pieces of 1/(k×j) partial matrixes are replaced in an optional order within each of k pieces of column division as a unit, and the matrix of signal data is operated based on this matrix of scan data.

9. The method for driving a passive matrix liquid crystal display device as in claim 8, wherein the matrix of scan data is divided into two equal parts in the row direction and in the column direction respectively, and the partial matrixes are replaced between a ¼ partial matrix positioned in the latter half of the row and in the former half of the column and a ¼ partial matrix positioned in the latter half of the row and in the latter half of the column.

10. The method for driving a passive matrix liquid crystal display device as in claim 8, wherein the matrix of scan data is divided into two equal parts in the row direction and in the column direction respectively, and the partial matrixes are replaced between a ¼ partial matrix positioned in the former half of the row and in the former half of the column and a ¼ partial matrix positioned in the former half of the row and in the latter half of the column.

11. A method for driving a passive matrix liquid crystal display device, comprising the steps of:

generating a matrix of signal data by operating a matrix of picture image data being input from outside with a matrix of scan data;

applying voltage to row electrodes in correspondence to the matrix of scan data; and applying voltage to column electrodes in correspondence to the matrix of signal data;

wherein the matrix of scan data is an optional sub matrix comprising two value elements of "1" and "−1" which averages a frequency difference of switching between "1" and "−1" in each adjacent column element being expanded with a unit matrix by Kronecker product, and after a non-0 element part is expanded stepwise in order to shorten an interval between each selective period, integral numbers j and k having values of two and more are used for dividing the matrix into k equal parts in the row direction (a column degree is divided into k) and into j equal parts in the column direction (a line degree is divided into j), thereby dividing it into k×j pieces of 1/(k×j) partial matrixes, and j pieces of 1/(k×j) partial matrixes are replaced in an optional order within each of k pieces of column division as a unit, and the matrix of signal data is operated based on this matrix of scan data.

* * * * *